United States Patent [19]

Brandenberg

[11] Patent Number: 4,594,007

[45] Date of Patent: Jun. 10, 1986

[54] TIME-PROGRAMMING APPARATUS

[75] Inventor: Winfried Brandenberg, Freienohl, Fed. Rep. of Germany

[73] Assignee: Westdeutsche Elektrogeratebau GmbH, Soest, Fed. Rep. of Germany

[21] Appl. No.: 571,550

[22] PCT Filed: Apr. 18, 1983

[86] PCT No.: PCT/EP83/00107

§ 371 Date: Dec. 20, 1983

§ 102(e) Date: Dec. 20, 1983

[87] PCT Pub. No.: WO83/03688

PCT Pub. Date: Oct. 27, 1983

[30] Foreign Application Priority Data

Apr. 20, 1982 [DE] Fed. Rep. of Germany ..... 3214372

[51] Int. Cl.[4] ..... G04B 47/00; G08B 1/00

[52] U.S. Cl. ..... 368/10; 368/82; 340/309.4

[58] Field of Search ..... 368/10–12, 368/28–29, 82–84, 250, 251, 107–113; 340/309.15, 309.4, 310 A; 364/569

[56] References Cited

U.S. PATENT DOCUMENTS

| | | | |
|---|---|---|---|
| 4,158,432 | 6/1979 | Van Bavel | 340/309.4 X |
| 4,204,196 | 5/1980 | Sveda | 340/309.4 |
| 4,264,034 | 4/1981 | Hyztin et al. | 340/309.4 X |
| 4,279,012 | 7/1981 | Beckedorff et al. | 340/309.4 X |
| 4,385,841 | 5/1983 | Kramer | 368/29 |
| 4,387,420 | 6/1983 | Singhl et al. | 340/309.4 |
| 4,418,333 | 11/1983 | Schwarzbach et al. | 340/310 A |

FOREIGN PATENT DOCUMENTS

| | | |
|---|---|---|
| 2296213 | 7/1976 | France . |
| 2415915 | 8/1979 | France . |
| 1546470 | 9/1972 | Switzerland . |
| 923609 | 4/1963 | United Kingdom . |
| 1572562 | 7/1980 | United Kingdom . |
| 1580020 | 11/1980 | United Kingdom . |

OTHER PUBLICATIONS

10e Congress International de Chronometrie, Geneve, Conference No. #2.5, Sep. 1979.

Microprocessor Controller Developments SP-426, Congress and Exposition, Detroit, Feb. 27–Mar. 3, 1978.

Euro Patent Search Report, EP 83 10 3713.

*Primary Examiner*—Vit W. Miska

*Attorney, Agent, or Firm*—Karl F. Ross; Herbert Dubno

[57] ABSTRACT

A time-programming apparatus comprises a central processor which includes at least one recording/read-out working memory having addressable registers, computing means with at least one logic circuit connected to the working memory for processing output signals therefrom, and at least one program memory with associated program counter connected to the logic circuit for the generation and distribution of function signals for the central processor. The apparatus further comprises a luminous digital display connected to the processor and divided into subregions with respective display fields for alphanumeric display, input means including manually actuatable keys and switches assigned to the display fields, and output means for selective actuation of a load to be operated, the input and output means being connected to the central processor and all including the luminous display, with a wall provided therefor, being contained in a common housing. Power means in the housing supplies electric power to the central processor, the input means being so connected to the processor as to define hierarchical functioning and including first and second function-selection means and a further selection means.

27 Claims, 48 Drawing Figures

G
109
105
H
122
121
116
118
68
107
106
67
120
111
110
114
115
E
I
C
117
119
B
113
D
A
108
104
101
102
103
112
105
F
K

FIG.6a
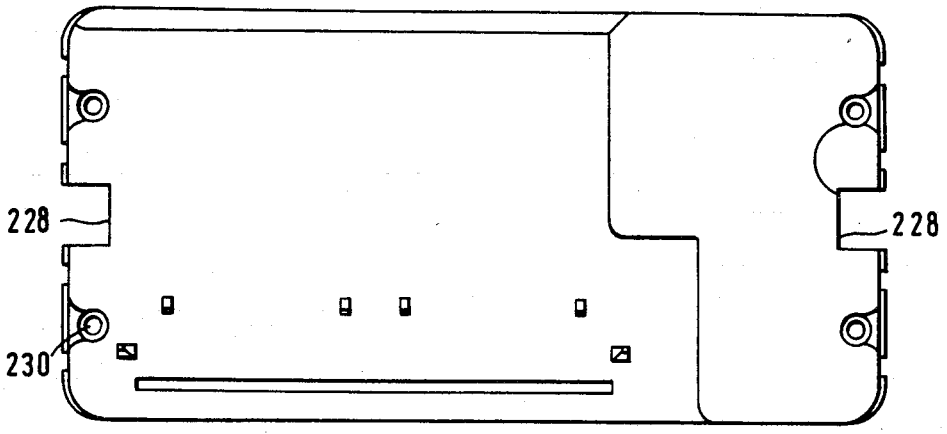
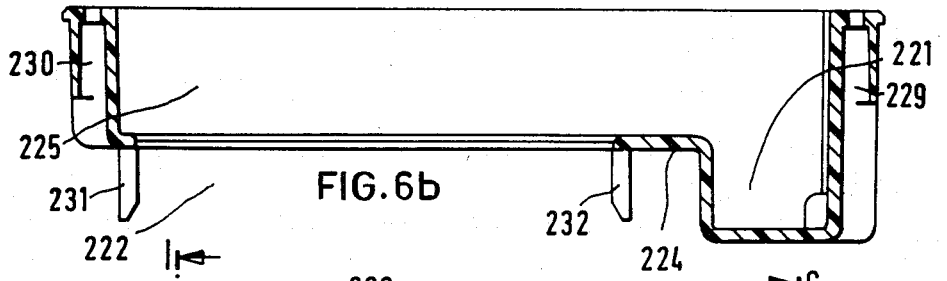
FIG.6b
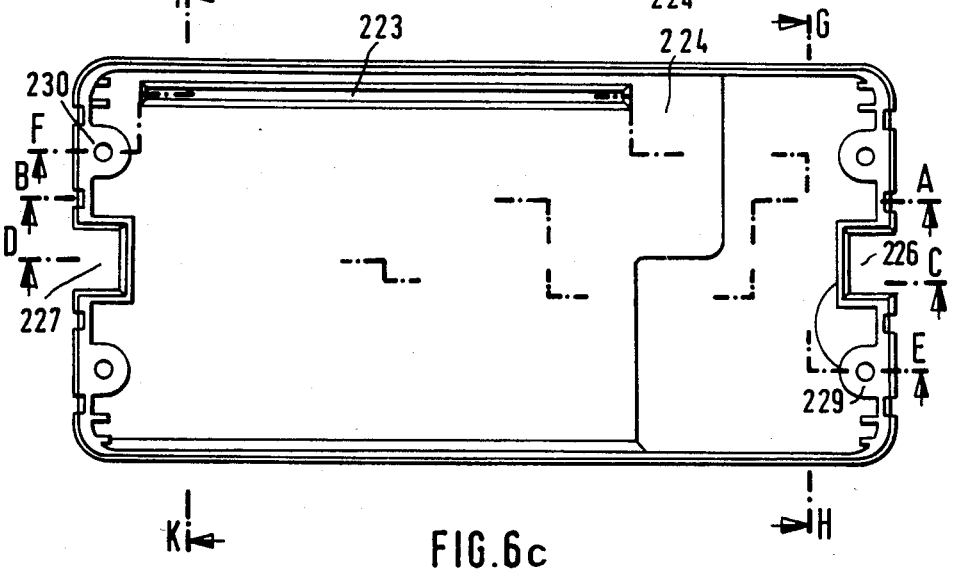
FIG.6c

N
O
221
224
225
226
227
228
229
230
231
233
234

RES
AS1..
I
ø
384
368
360
386
d
351
379
393
394
361
369
374
h
352
362
370
387
387'
m
353
363
371
S
354
364
372
388
SK
( S1...)
355
380
389
383
390
365
373
385
356
ABF
382
366
381
357
QUI
391'
I
391
367
358
375
CLE
ø
392
359
$T_{1,2}$
377
$T_1$
376
378
COMPL.

CHECK
601
NO
YES
602
T10
YES
NO
CHECK
YES
NO
YES
NO
(S1-2)?
NO
YES
YES
FULL?
YES
NO
7:30
12:00
605
604
6:30
16:30
NO
"0"
YES
606
00:00
00:00
FULL
603
607
YES
h,m,d1-7(S1-2)
NO
CHECK
YES
608
NO
609
YES
NO
CHECK
YES
610
611
NO
FULL
YES
FULL?
NO
612
12:30

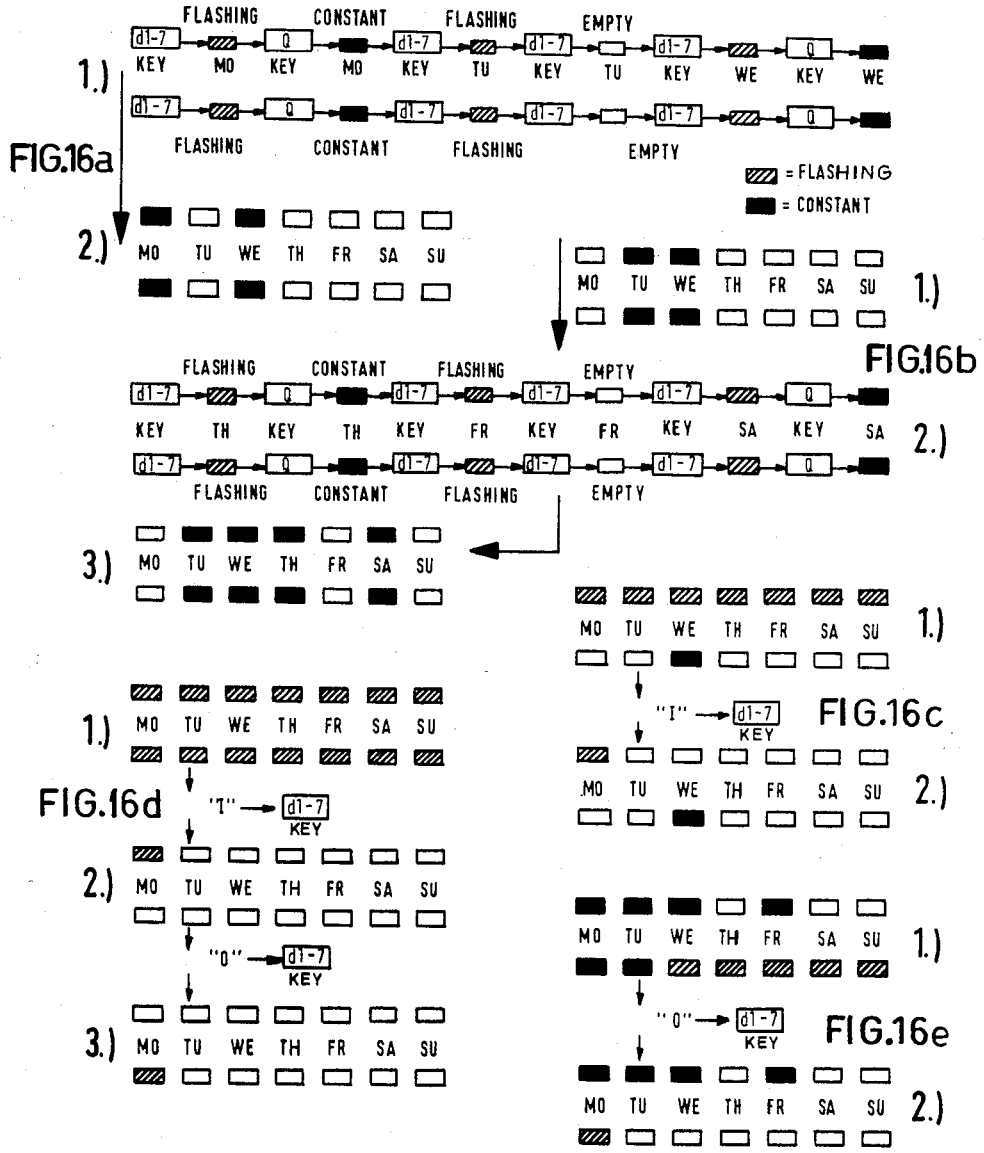
FIG.16a
FLASHING
CONSTANT
FLASHING
EMPTY
d1-7
Q
KEY
MO
TU
WE
= FLASHING
= CONSTANT
MO TU WE TH FR SA SU
FIG.16b
TH
FR
SA
FIG.16c
"I"
FIG.16d
"1"
"0"
FIG.16e
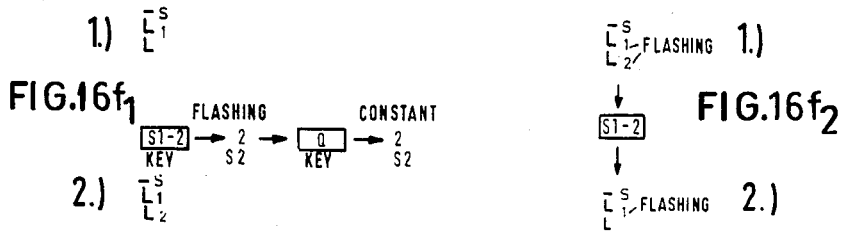
FIG.16f1
FLASHING
CONSTANT
S1-2
KEY
Q
S2
FIG.16f2

TIME-PROGRAMMING APPARATUS

CROSS-REFERENCE TO RELATED APPLICATIONS

The present application is a national-phase filing of International (Patent Cooperation Treaty) Application No. PCT/EP83/00107 filed Apr. 18, 1983 and based on Federal Republic of Germany Application No. P 32 14 372.9 filed Apr. 20, 1982.

FIELD OF THE INVENTION

My present invention relates to an electronic timer or time-programming apparatus.

BACKGROUND OF THE INVENTION

An electronic timer or time-programming apparatus can comprise an electronic clock with pulse generator and several divider stages, a central unit with read/-write or read-only working memories, a calculating—i.e. arithmetic logic—unit for data processing, as well as a program memory with associated program-counting and decoding devices; further, a luminous-digit arrangement, an input unit with operating elements such as keys and switches, an output unit for the activation or deactivation of switching devices for load circuits; and, finally, control and current-supply assemblies as well as a housing in whose front wall operating and setting fields and at least one luminous-digit device are disposed.

In recent times the demands made on a timing or time-programming apparatus, especially switching clocks with electromechanical drive and mechanical switching devices such as radially displaceable switching segments, plug-in connecting pins or the like, have become ever more exacting. Thus, at present and increasingly so, one expects at least several time-switching programs, i.e. with differences for each day of the week and also for different switching channels with partly different time-switching programs, to be easily and correctly settable.

To be sure, electronic timers have lately been introduced into the market with sophisticated multiply interdigitated time and channel programs; it has been shown, however, that these programs are susceptible in various ways to the input of erroneous instructions and that their correction entails problems since, for example, whole sections of the switching program must be erased and the corresponding switching data must be fed in again from the beginning. Thus, e.g. with the known electronic time switch "GRAESSLIN digi 127", it is possible to load it with impermissible time data, such as a response at 26.84 hours for weekday "9", because of the use of a decimal keyboard for the infeed of the switching-time data; while such error is indicated by flashing, it still requires an erasure of the entire time input and its repetition in a prescribed and fixed sequence, i.e. from the beginning.

Furthermore, with the known time switch it is not possible to feed in and indicate a complete set of switching data, but only a partial section thereof, e.g. for a single weekday and with either an ON or an OFF switching time; combinations such as several weekdays with the same ON and OFF switching times can be neither displayed nor simultaneously checked. The instructions for use are accordingly conveyed in a specimen programming sheet.

OBJECT OF THE INVENTION

The object of my invention is to provide an improved timing or time-programming apparatus, i.e. to design and construct the indicating arrangement for the ON and OFF switching times with any number of weekdays and possibly different switching channels—selectively adjustable in any desired alternation of the sections of the complete data package—with the operating elements and intermediate memories so combined and controllable that:

the individual switching times and ancillary data can be entered in any desired sequence, with entry of impermissible switching-time data excluded a priori;

erroneous or no longer desired input data of switching times can be corrected in individual sections; and, during the entire setting procedure, complete data packages with ON and OFF switching times, days of the week and ancillary data, e.g. selected switching channels or choice between ON and OFF switching time, as desired, can be plainly read, entered or rectified.

SUMMARY OF THE INVENTION

This object is achieved with an electronic timing or time-programming apparatus which comprises:

an electronic clock with pulse generator and several distribution stages for time-segment data signals, e.g. weekday "d", hour "h", minute "m", (optionally) second "s" or the like, and pulse signals for larger time segments;

a central processor with recording/readout working memories with addressable cells or registers in groups, and/or fixed value memories, a computing unit i.e. an arithmetic logic unit or comparator stage for processing the data output signals of these sub-assemblies, as well as program memories with associated program counter and decoder devices for the generation and distribution of function signals for the control of electronic sub-assemblies of the central processing unit;

a luminous digital device divided into sub-regions with display fields for groups of digits, letters, signs and/or symbols;

an input unit with operating elements, such as keys and switches assigned to the display fields and arranged together by groups into sub-regions;

an output unit for the actuation or deactuation of switching units, e.g. electromagnetic relays, electronic switching devices or the like for load circuits, optionally having several channels and/or switching amplifiers; and control and power supply sub-assemblies and a casing, with operating and setting fields as well as at least one luminous digital device arranged in the front wall thereof.

In combination therewith, the invention provides that:

(a) the operating elements are connected to the control inputs and outputs of the central processing unit, and are designed and constructed for the following:

($a_1$) a first function selection, e.g. for "AUTOMATIC/CONTROL" and/or switching ON and OFF of the switching channels in the form of ON/OFF switches or interchange switches, ($a_2$) a second function selection, e.g. for the actual time of day (UHR), switch-ON time setting (EIN), switch-OFF time setting (AUS), switching channel selection and/or automatic operation selection (AUT), in the form of function selection keys, as well as ($a_3$) the setting of switching time data "h", "m", optionally "s", the choice between switch-ON and switch-OFF time input, the choice of days of the week or switching channels and the intermediate storage of same, in the form of setting keys for the input of distribution stage impulses, or selection keys and confirmation keys.

In addition:

(b) the sub-regions are equipped with display elements for signals assigned to clock time data of switch-ON times and/or switch-OFF times and for signals assigned to output switching channels together with signals for indicia e.g. "I" and "O" for the ordering of the switch-ON and switch-OFF times, and/or for symbols e.g. colon between the "h " and the "m" display elements, e.g. for the ongoing display of second-pulses by flashing, with display elements for 7 bars and arrows which can be arranged in rows, for the weekdays etc., by means of the function selection switches or keys with mutual exclusion or mutual release of one signal in random succession into associated intermediate memories adapted at least partly for threshold value overflow, e.g. for 7 days of the week, 10 decimal places and 6 unit places for the clock time, and/or with two inputs for the two opposite polarities ("+/−") of the impulses to be fed in.

The data package signal groups for switch-ON and switch-OFF times and the associated switching channels from intermediate memory cell groups can only be accepted into the central processing unit in their totality and therein processed, inasmuch as the signal groups of the sub-regions of the data packages can be connected to the corresponding inputs and outputs of a programming memory or a recording/readout working memory by way of parallel and/or serial logic interconnection stages or comparator stages.

This combination provides the technological advance that, during the entire manipulation i.e. the establishment, the completion, partial cancellation and correction of a pair of ON and OFF switching times, there is afforded a high degree of overview of the entire associated data package including the days of the week and the switching channels pertaining to this pair, enabling a steady supervision of all setting-up actions and thus operation without particular training or requirements of skill on the part of the operator. The advantages thus achieved are further enhanced by realizations in combination with additional special features so that functional reliability, which otherwise is attainable only to a limited degree, is still better achieved in precisely a timer of such sophistication and versatility of use.

According to the invention, the separately addressable cells or registers are assigned in groups. The programming memory and the recording/readout working memory are assigned (a) to a part-programming memory for a half-data package with clock time data or data of the switch-ON or switch-OFF times and optionally of the switching channels, and to the working memory which may be spatially separated therefrom, and can be at least partly supplemented by an external additional recording/readout memory, (b) to at least one auxiliary register for a complete data package with switch-ON and switch-OFF time data including data for days of the week, and optionally for switching channels, and furthermore (c) to separately addressable intermediate memories in the working memory for data of the clock time, or the switch-ON and switch-OFF times, for data of the days of the week, for data of the switching channels, for data of the actual states of the switching apparatus, for setting indicia and/or indexes for switch codes and/or key codes, constants, addresses, time counter data or the like, the recording inputs of all of which can be connected to outputs of the input unit and/or of the other registers and the readout outputs of which can be connected to inputs of an input memory of the luminous digital display apparatus or of an intermediate memory associated therewith.

Moreover, the outputs of all cells of the programming memory assigned to the positions of the complete data package lie, for the purpose of examination for completeness, at the inputs of a logic interconnection sub-assembly with AND-elements and/or NAND-elements and/or counters, shift registers and/or a comparator stage or with the like optionally serial multiple functions, whose output signal lies at the input of an AND-element, the other input of which is coupled to the output of the programming memory; the latter's outputs, when the interconnection condition is fulfilled, are coupled to corresponding inputs of an auxiliary register in the working memory, while when it is not fulfilled a flash command signal is sent to each display element of unoccupied sub-region positions of the memory cells.

The outputs of all cells of the programming memory assigned to the positions of the complete data package lie, for the purpose of examination for compatibility with or plausibility of the input data, at the inputs of a logic interconnection sub-assembly with AND-elements, NAND-elements, OR-elements or EXOR-elements and/or counters, shift registers and/or comparator stages or the like optionally serial multiple functions, the output signal of which lies at one input of an AND-element, whose other inputs are connected to the outputs of the programming memory or whose other input is connected to the output of that AND-element which belongs to the interconnection sub-assembly for the completeness examination, whereby these connections can only be made when the compatibility condition is fulfilled or, when it is not fulfilled, the display elements belonging to the incompatibly occupied memory cells are sent a flashing signal command.

The outputs of a first (i.e. switch-ON) partial data package of the programming memory and the read-out outputs of a second (switch-ON) partial data package of the recording/read-out working memory can be connectable to and addressed to data packages of equal channel data in continuous fashion by means of the result of a comparator stage with AND-elements in rising sequence from one switch-ON partial data package (in the presence of the following related switch-OFF partial data package) to the respective next switch-ON partial data package by means of the addressing counter which has been raised each time by one, whereby the addressing counter continues to be advanced until a third (i.e. switch-OFF) partial data package of the recording/read-out working memory is greater than the first switch-ON partial data package of the programming memory, whereby furthermore the resulting signal of the comparator stage blocks the takeover into the recording/read-out working memory through the AND-elements in a first set of circumstances, and releases the takeover of the relevant complete switch-ON and switch-OFF data package from the programming memory into the recording/read-out working memory in a second set of circumstances, the first set of circumstances comprising equality of the first ON and the fourth OFF partial data package of the programming memory or of the first switch-ON and the second switch-OFF partial data package of the programming memory on the one hand, or of the fourth switch-OFF and the third switch-OFF partial data package of the programming memory, or of the recording/read-out working memory, and finally if a fifth switch-ON partial data package of the recording/read-out working memory (i.e. following on the third or switch-OFF partial data package) is smaller than the fourth, i.e. the switch-OFF partial data package of the programming memory, and the second set of circumstances comprises a positive difference between the first switch-ON and the second switch-ON partial data package and/or between the fourth switch-OFF and the third switch-OFF partial data package while the complete, stored switch-ON and OFF data package is erased.

The content or contents of one, several or all cells or sub-regions of a register belonging to the displayed data package for at least one pre-selectable channel and/or weekday can be interchanged or erased by actuation of the relevant key or keys independently of the other sub-regions.

The content of at least one cell of a sub-region of the register appertaining to one data package can be set to or altered by one value step at a time, by a single actuation of a setting key, or can be set to or altered by a correspondingly greater number of value steps by means of a key actuation which lasts for the duration of a predetermined time interval, and the setting or alteration can be applied in an increasing or decreasing sense by the use of an "−" or a "+/−" additional switch.

Each of the signal circuits for the setting keys can contain a parallel and/or serial AND or OR logic interconnection stage for cancellation of the electrical effect of the respective previously actuated function selection key, i.e. for UHR, EIN, AUS, AS1 . . . , AUT, and vice versa.

Each of the signal circuits for the setting keys, e.g. "d", "h", "m", "s", "S1 . . . ", ABF, QUI, CLE, can comprise a parallel and/or serial AND or OR logic interconnection stage for blocking the electrical effect of the former by means of the function selection key AUT.

The input memory for TAG and/or KAN is designed as a shift register, and there lies between it and the corresponding register a parallel or serial logic interconnection stage for confirmation in the case of multiple storage of TAG or KAN data or associated indexes.

Between the input circuits of the function selection keys and of the setting keys there lies a parallel and/or serial logic interconnection stage for blocking their electrical effect by means of the function selection main switch "STEL/AUT" in one of its positions.

Channel selection switches are assigned to the switching channels, by means of which switches the channel can be set independently of and out-ranking the function and selection keys.

In the signal circuit of the setting keys for "h", "m", "s", there lies a parallel and/or serial logic interconnection stage for release of the signal circuit of the ABF key when the AND condition is fulfilled firstly with the signals of the function selection key AS1 . . . , and then with the ON or the OFF setting key and, optionally, with the TAG setting key.

In the signal circuit of the function selection keys and of the setting keys there can lie a parallel and/or serial logic interconnection step with the signal circuit of the CLE key for the cancellation of the electrical effect of those of the said keys that have been actuated immediately beforehand, or for erasure of the corresponding section of the displayed data package.

In the signal circuit of the function selection keys there may be a shift register device for switching them over from the control circuit of a respective one of the associated function selection circuits to a next one thereof, e.g. in the sequence "UHR−EIN−AUS−AS1 . . . −AUT−UHR . . . etc." by successive actuation of the function selection keys.

In the signal circuit of the setting keys, e.g. "h", "m", "s", moreover, there can be a shift register device for switching the first thereof over to the respective next one in the given sequence, with intermediate connection of a parallel and/or serial logic interconnection step (in the case of the setting keys "d" and "S1 . . . ") for the previous actuation of the confirmation key after one or more actuations of the relevant setting key for which the AND condition is fulfilled.

The signal circuit of the function selection keys contains a timing device for resetting it after the lapse of a pre-settable time interval, e.g. 40 seconds, if none of the setting keys is actuated within this interval.

The operating elements are advantageously arranged in a matrix consisting of groups spaced to reflect their priority, namely as function switches, function keys and setting keys, the matrix having addressing lines in one coordinate and read-out lines in the other, whereby the operating elements are arranged at the intersections of those lines, and are so connected that a CODE arises on the arrival, at the respective output of the read-out lines, of a given address assigned to a respective operating element, said code being unambiguously defined for the groups of the operating elements in characteristically limited number sets, e.g. for keys inside the decimal region O to F the code lies in the lower part of said region, e.g. "2" for the AUT key, lies in its upper part, e.g. greater than "10" for function keys, and lies in its mid-part therebetween from "3" to "10" inclusive, for setting keys other than AUT.

An AND-element and a FLIP-FLOP member can lie between each function selection key connected to a clock impulse source and the inputs of the parallel AND or OR logic interconnection stages for the items set out below, whereby the Q-outputs of all others of the latter are connected to the other inputs of the former, so that each time a function key is actuated, the FLIP-FLOP sub-assemblies of all the other such keys are reset, the items mentioned being: the data inputs of the sub-assemblies for the actual time of day, the switch-ON and switch-OFF times, the switching channel of the programming memory, of the input memory of the digital display apparatus, and of the auxiliary register for a complete data package, as well as of the intermediate memory for data of the actual time of day, the switch-ON and OFF times, the days of the week and the switching channels.

Between each of the setting keys connected to a clock impulse source derived from the CLOCK sub-assembly and the inputs of the time segment distributor stages and the switching channel stage, two items can be connected, firstly an AND-element to the respective other input of which the $\overline{Q}$ output signal of the FLIP-FLOP member assigned to the AUT key is connected, and secondly a monostable FLOP member with limited time duration of the Q output signal and automatic resetting after a predetermined interval, the $\overline{Q}$ output of which, interconnected with the output signals of the FLIP-FLOP members of the function signal keys "EIN" and "AUS" controls a respective FLIP-FLOP member, the Q output signals of which, connected to an AND-element give rise to a release signal for the take-over of the output signals of the sections of the input memory of the digital display apparatus.

A pair of AND-elements with their outputs connected together can serve as a clock impulse source, the first input of a first of which connects with the "1-s" divider stage, and the first input of the second of which connects with the "$\frac{1}{8}$-s" divider stage of the clock sub-assembly, their other inputs being connected to the $\overline{Q}$ output or the Q output of a time-delayed controlled monostable FLOP-member, and whose input, by way of a time-delay element, is commanded by the Q output of the monostable members of the setting key signal circuits by way of a common OR-element.

The output signal of the electronic clock is connected via a respective AND-element to each input of the logic unit (LE), as are the output signals of the intermediate memory for the data sections of the actual time of day, the switch-ON and the switch-OFF times including the weekdays and the switching channels likewise connected to each input of the logic unit (LE), whereby in each case the other inputs of the AND-elements are controlled by the output signal of the FLIP-FLOP member of the switching group belonging to the AUT-key.

Switches with at least two positions are provided in the control circuit of each of the switching groups for the release or blockage of the actual state thereof in one of its operating states.

A switch with two positions "STEL" and "AUT" can be provided in the control circuit of each of the function selection keys with the exception of the AUT-key, for blocking the input with the setting key in the case of actuation of the AUT-key.

The output signal of the OR-element in the signal circuit of the CLE-key can be connected to the resetting circuit of the monostable FLOP-members in the signal circuit of the setting keys, and the $\overline{Q}$-output signal of a time-delayed control monostable FLOP-member is connected in the resetting circuit of the FLIP-FLOP members in the signal circuit of the function selection keys, the input of the latter FLOP-member being commanded by an OR-element which in turn is input controlled by the $\overline{Q}$-output signals of the FLIP-FLOP members in the signal circuits of the function selection keys.

According to the invention, at least some of the electronic sub-assemblies are structurally integrated components of a commercially available microprocessor which has an arithmetic-logic unit, a recording/read-out working memory, input and output registers for addressing, data read-out and data transfer to the switches and/or the function selection keys and setting keys, all of which may be grouped in a matrix, as well as data transfer from and to the intermediate memory or memories for data and addressing, and inter alia accumulators (A), B-registers etc., constant memories, counters for time intervals, shift registers for logic interconnection and comparison routines performed on the content of memories and for their differential estimation with the help of groups of AND-elements or OR-elements.

The AND, OR, FLIP-FLOP and MONO-FLOP sub-assemblies, counters for time intervals and/or memory data words, shift registers, constant memory places of the serial logic interconnection and comparator stages can be at least partly replaced by the command word-containing locations in a program memory with decoder for the derivation of function signals from the operational segments of the stored command words.

The digital display apparatus, constructed as a compact semi-conductor unit and technologically integrated with microprocessor sub-assemblies, preferably in C'MOS technology and with LCD liquid crystal display elements, is mounted on a circuit board with galvanically applied conducting tracks and connected thereto by means of connecting tags, the circuit board being held between an upper casing part and a lower casing part, the upper casing part having a window void for the display field containing the display apparatus, and an operating and setting field arranged adjacent to the window and having function selection keys and setting keys as well as function selection switches, the upper casing part being adapted for assembly by approximating its matching wall edges and screwing them together to a complete casing, the assembly being self-adjusting by means of adapter parts, ribs, partitions and prongs for spacing and securing purposes.

The circuit board is reinforced by further circuit boards positioned at right angles to the two long sides thereof, on which circuit boards the components of power supply, rectifiers, electric battery, condensers etc., relays or the like, and plug socket rails are arranged, the latter in the form of galvanically applied contact strips.

The lower casing part preferably has grooves on two opposite side walls for holding it to the complementary piece under tension by means of hooks, the grooves being preferably provided with teeth on their inner sides; the lower casing part is thus adapted for use firstly in the presence of a front-wall cutout for the inserted mounting of an assembly plate of an electronic device framework, and secondly in the presence of an assembly cover of pot-like shape, closed apart from break-through places for connecting lines, said cover being for the protection of the rearward parts and connections of the lower casing part against unsuitable handling.

The function selection and setting keys are designed as fingers made from a rubber-like substance rendered conductive by means of additives, each such finger having a neck of rectangular cross-section, the keys being guided through appropriate rectangular perforations in the front plate, these perforations having peripheral cross-shaped integrally molded ribs on the underside of the front plate, and with a head plate lying opposite the circuit board and used as a current connector between the conducting tracks touched on actuation of the keys, and with a common elastic layer with integrally molded adapter parts, to which layer said keys are integrally and hermetically bonded.

The display field and the adjacent operating and setting fields, having adjacent sides of at least approximately equal length, are unified in the front plate of the upper casing part to form an elongated rectangle having a side ratio of two to one; the display field can be covered by a transparent cover hood that fits onto the upper casing part between the side walls thereof, to render it secure against dust and damage.

BRIEF DESCRIPTION OF THE DRAWING

The embodiments of my present invention are described hereinafter with reference to the accompanying drawing in which:

FIG. 6*a* is a bottom view of the lower casing part;

FIG. 6*b* is a longitudinal section along line E-F of FIG. 6*c;*

FIG. 6*c* is an elevational view of the lower casing part;

FIG. 16 shows examples, in block form, for display of days of the week. More particularly:

FIG. 16*a* shows the setting for two days;

FIG. 16*b* shows the supplementing of a pre-existing setting and the sequence of key actuation therefor;

FIG. 16*c* shows a setting for absence of switching-ON days;

FIG. 16*d* is for a setting showing absence of switching-ON and switching-OFF days;

FIG. 16*e* is for a setting showing the number of switching-ON days exceeding the number of switching-OFF days;

FIG. 16$f_1$ shows the positioning and confirmation of switching channels;

FIG. 16$f_2$ illustrates switchover to first switching channel from second switching channel to correct an erroneous setting.

SPECIFIC DESCRIPTION

Figure 1C:
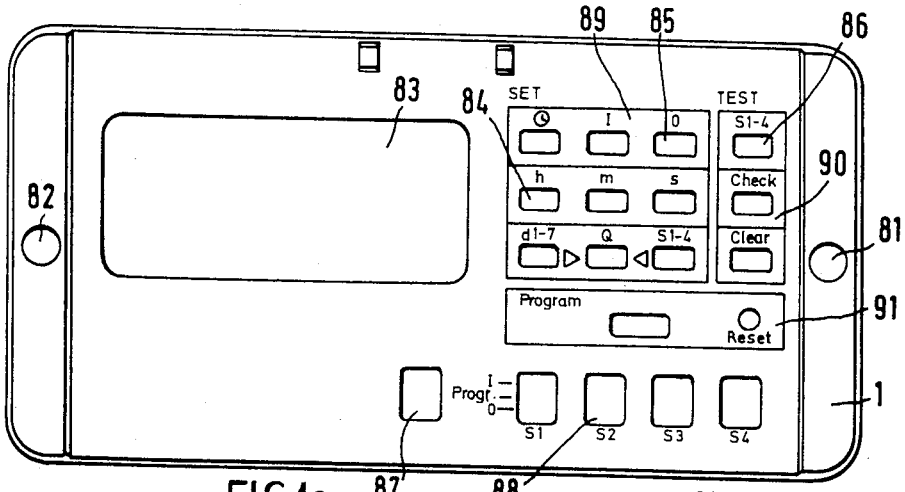
FIG. 1*c* is a view of the unfurnished casing, i.e. its upper portion with labeled overlay mask for the operating field.
Figure 1B:
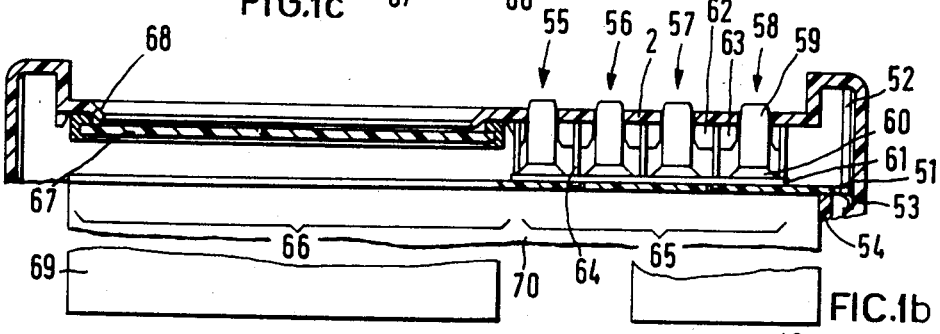
FIG. 1*b* is a partial longitudinal section thereof.
Figure 1A:
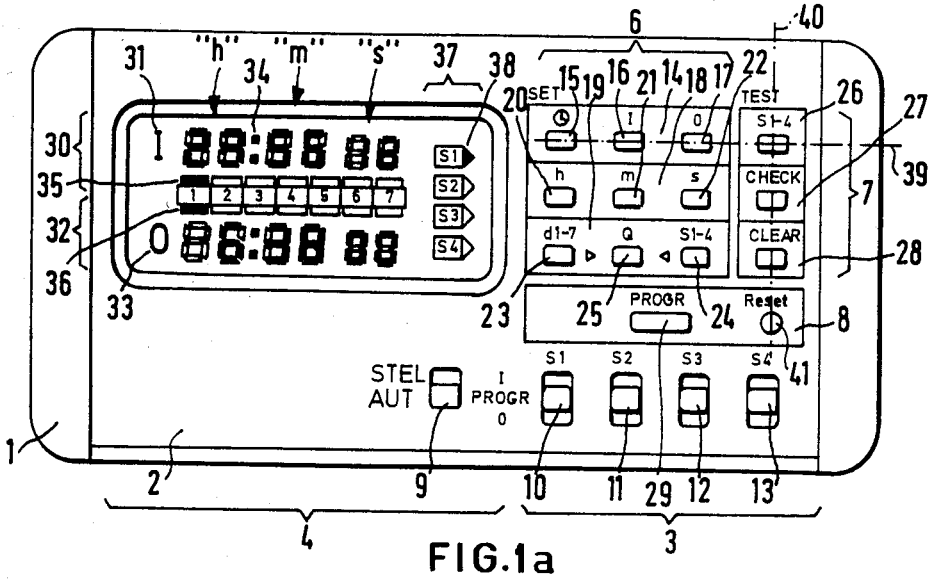
FIG. 1*a* is a view of the timing switch with closed casing.

FIG. 1*a* shows—from the front as a front elevation—the timer of the time-programming apparatus of my invention, this timer having a closed casing 1 whose front plate 2 is subdivided into an operating field 3 and a display field 4. The operating field 3 is in turn subdivided into field sections 5 to 8, corresponding to the rank order of the operating elements, with the lowermost field section 5 assigned to the main function-selection switch 9 "STEL/AUT" and to the group of switching-channel selectors 10 to 13 ("S1 to S4"), the upper zone 14 of the key area 6 "SET" being assigned to the function-selection keys 15 (CLOCK), 16 (switch-ON time) and 17 (switch-OFF time), the middle zone 18 and the lower zone 19 being assigned to the setting keys "h" 20 (hours), "m" 21 (minutes), "s" 22 (seconds), "d1-7" 23 (days of the week), "S1-4" 24 (switching channels) and "Q" 25 (acknowledgment); the last-mentioned key pertains to that modification of single-position input, possible in the two cases "d1-7" and "S1-4", by which repeated actuation of the setting keys themselves permits the days of the week and the switching channels to be shifted by one position, thus with cancellation of the previously entered value and transfer of the corresponding symbol into the respective intermediate memory to augment the data that may already be stored there, only upon actuation of the setting key "Q".

With the function-selection key "S1-4" 26 in the control field section 7 "Test" (ABFR)—also denoted "AS1"—scanning is initiated; with the setting key "Check" (ABFR) 27 the actual scan of the complete currently available data package is started, while with the setting key 28 "Clear" (CLE) the scanned section of the data package is canceled. Upon actuation of the function-selection key 29 "PROGR" or "AUT" the automatic operation, after being interrupted by one of the function-selection keys 15, 16, 17 and 20, is re-established.

In a scanning operation, the display field 4 indicates the complete data package for a switching time-pair, or a part thereof, on first entry following complete cancellation, with the switching-time display divided into an upper half 30 for the switch-ON time, having the symbol "I" 31, and a lower half 32, mirror-symmetrical thereto, having the symbol "O" 33; each half contains, besides, the clock times "h", "m" and "s" with a colon between the data for "h" and "m", respectively above and below the same bar symbols 35, 36, at seven juxtaposed positions corresponding to the days of the week and, in the right-hand sector 37 of the display field 4, superposed arrows, e.g. 38, for the display of the selected switching channels.

The special subdivision of the operating field 3 and the display field 4 gives the user a particularly easy and errorfree method of setting the switching-time data. With the routine chosen by means of the function-selection switch "CLOCK" he can set the built-in electronic clock by depressing the setting keys 20 to 22 "h", "m", "s" and "d1-7" for the one applicable day of the week, sufficiently often or (with automatic pulse sequence) long enough to let the corresponding sectional value agree with the actual time of day whereupon, by actuating the function-selection key 29 "AUT", he causes the transfer of the selected half data package to the intermediate memory for the actual time of day, as well as the unblocking of the continued automatic operation of the electronic timing apparatus along with the continuous automatic readjustment of the built-in electronic clock.

In order to set the switch-ON and switch-OFF times, the user has merely to actuate one of the function-selection keys "I" 16 and "O" 17 and then again the setting keys 20 to 25, one after the other in any sequence, for the desired switching times, days of the week and switching channels, as is likewise necessary for the desired values to be displayed in the individual sections; when this has been achieved, he again merely has to operate the function-selection key 29 "AUT" or "PROGR", whereupon the complete data package appearing in the display field 4, in the form of the relevant digits, signs and symbols, is transferred into the working memory or its associated register, and the "AUT"-operation is also re-established.

In performing the above, the condition must be observed that all sections of the complete data package, possibly including "zero" (00) for example, are entered; so that the data set is "perfected", no display appears in any position without actuation of the relevant setting key 20 to 25. This condition can be limited, in a simplified embodiment of the electronic timer, to a "half data package", such half package being then displayed in turn for the actual time of day, for the switch-ON time and for the switch-OFF time; in a less simplified embodiment, however, the completeness condition is still verified for the entire data package.

In addition to the continuous visualization described, the hierarchically ordered geometric layout of the setting keys 20 to 25 and of the function-selection keys 15 to 17 and 29 simplifies the operation since the function-selection keys 15 to 17 and 29 are arranged in a common line 39; the group of keys 26 to 28 for stepwise scanning, correction and cancellation (which also includes the overall-resetting function by means of the pushbutton 41 "Reset") is arranged in a line 40 perpendicular thereto, and the actual setting keys are accommodated in the interposed field section.

In its position "AUT", the main function-selection switch 9 protects the totality of all stored complete data packages against unauthorized or inadvertent alterations, inasmuch as the function-selection keys 15 to 17 and 26 as well as the setting keys 20 to 25 are blocked and inoperative. The associated peculiarities of the electronic circuitry are the subject of a separate and independent description.

In FIG. 1*b*, a longitudinal partial section, the circuit board 51 is shown self-adjustably supported by clamping between ribs 52 integrally molded on the sidewall 52 of the upper casing part and the front faces of the sidewall 54 of the lower casing part. The function-selection and setting keys 55–58, fabricated from a rubber-like substance made conductive by additives, are each composed of a neck 59, of rectangular cross-section, and a head plate 60 and are all interconnected with an elastic base 61 to which they are integrally (unitarily) joined. Upon actuation of one of these keys, the base 61 is pressed underneath the respective neck against the circuit board and the conductor terminals present at this location are conductively connected, i.e. the switching action is effected. The necks 59 of keys 55 to 58 are guided by webs 62, 63 integrally molded on beneath the front plate 2, and the base 61 is held at an exact self-adjusting uniform distance from the front plate 2 by means of intermediate webs 64, likewise integrally molded thereon.

The compact semiconductor module 67 with the display device and associated electronic components is built into the display field 66 adjacent the operating field 65, immediately below the window 68 in the front plate 2, and is electrically connected with the conductor strips of the circuit board 51 by corresponding terminal tabs. Circuit boards 69, 70 are secured to the inner surface of the circuit board 51 perpendicularly thereto, as shown, for mechanical reinforcement and for the mounting of bulkier components, such as capacitors of the power-supply section, a battery for working reserve, and the relays.

FIG. 1*c* shows the unfurnished upper casing part 1 with perforations 81, 82 for screwing it to the lower casing part, with cutouts for the window 83 belonging to the display unit, for function-selection keys and setting keys, e.g. 84, 85, 86, function selectors, e.g. 87, 88, and the masks 89, 90, 91 for the field sections 6, 7, 8 (FIG. 1*a*).

Figures 2A, 2B, 2C, 2D, 2E:
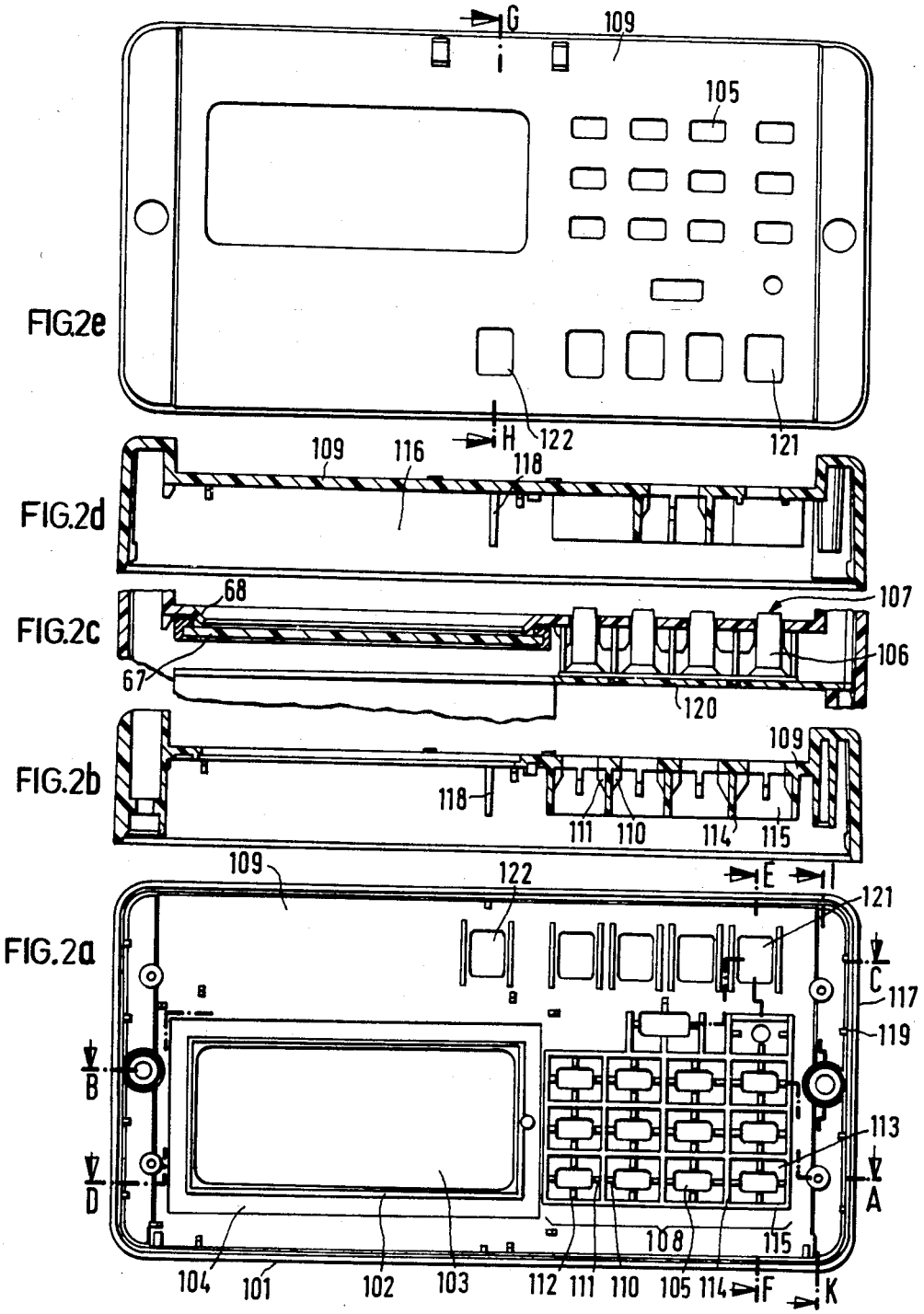
FIG. 2*a* is a view of the unfurnished upper portion of the casing without overlay mask, showing section lines.
FIG. 2*b* is a stepped longitudinal section taken along line C-D of FIG. 2*a* for the illustration of details of the switch mounting and key guidance.
FIG. 2*c* is a partial section with a circuit board.
FIG. 2*d* is a stepped partial section taken along line A-B of FIG. 2*a*, to represent in particular the guide ribs for the key shanks.
FIG. 2*e* is a bottom view of the upper part of the housing with the guide ribs for the key shanks integrally molded on in its interior.

FIG. 2*a* shows, in the bottom view of the upper casing portion 101, the integrally molded-on frame 102 of the window 103 for a nonillustrated display unit and the holding frame 104 for the latter, as well as the cutouts, e.g. 105, for the necks (here not shown) e.g. 106 of the finger 107 (FIG. 2*c*) belonging to a setting key, and the guide ribs, e.g. 110 to 113, integrally molded onto the underside of the front plate 109 and collectively forming a grid 108, at all four sides of the rectangular cutouts, e.g. 105, and interconnected reinforcing ribs molded integral therewith, e.g. 114, 115. On the inner surface of the walls, e.g. 116, 117, on further notes supporting rings molded onto same, e.g. 118, 119, for the circuit board 120 in FIGS. 2*a*, 2*b*, 2*c* and 2*d*. FIG. 2*e* shows in plan view the completely unfurnished front plate 109 with cutouts, e.g. 105, for the neck (e.g. 106) of a key, for a channel switch 121 as well as for the main function-selection switch 122 ("STEL/AUT").

Figure 3:
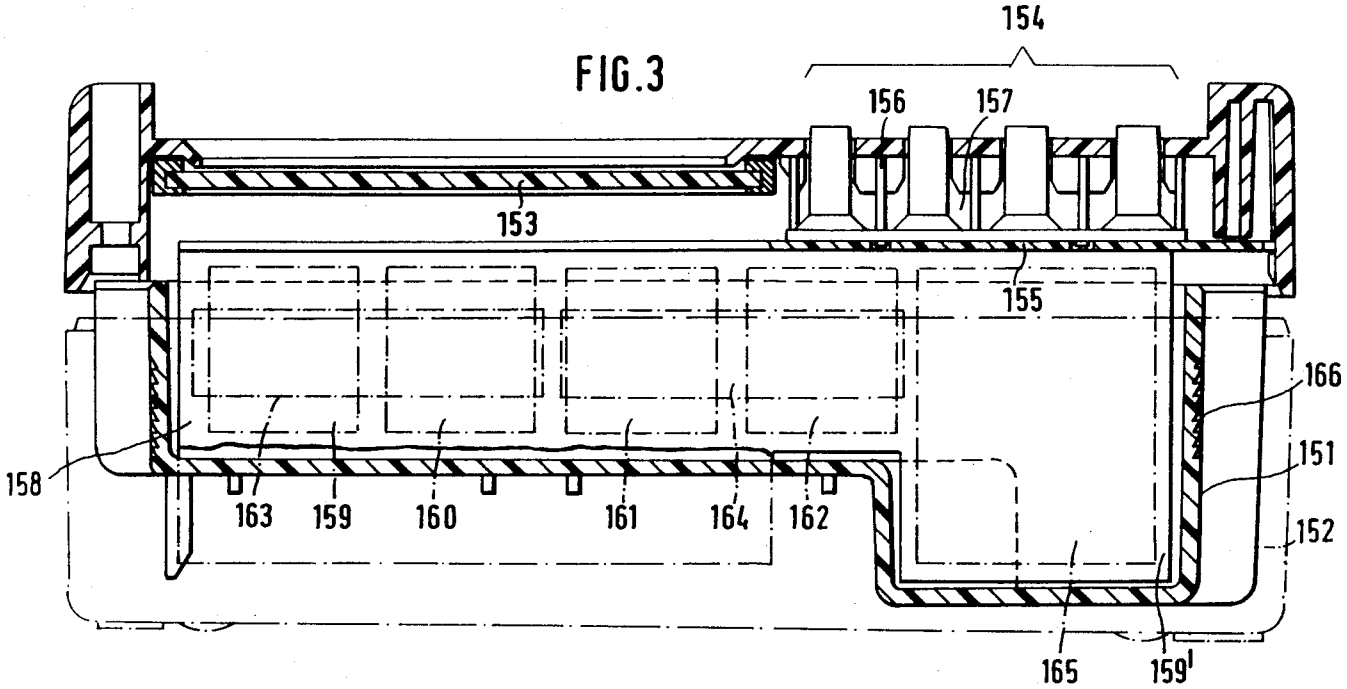
FIG. 3 is a longitudinal sectional view of the actual housing assembled from the lower casing part with superposed upper casing part and the circuit board clamped therebetween, and with phantomization of its equipment simulating an envelopment of the lower casing part by a pot-shaped cover with frangible wall parts for the passage of connecting lines.

FIG. 3 shows a longitudinal section A-B through the upper casing part, supplemented by a longitudinal section through the lower casing part 151 and by a phantom longitudinal view of the cover 152, which is equipped with a compact semiconductor module 153 for the display device and with a group 154 of setting keys. Also shown is the clamping attachment of the circuit board 155 between ribs, e.g. 156, which are integrally molded on the longitudinal sidewall 157 and the lower casing part 151, i.e. the upper edge thereof. On the circuit boards 158, 159 orthogonally mounted on the underside of the circuit board 155 at the longitudinal edges thereof, longer components are internally disposed, such as relays 159 to 162, electrolytic capacitors 163, 164 and the other parts of the power-supply section 165 (again represented in phantom). In this way, even with the novel manner of construction with digital electronics, a sufficiently robust and compact design of the electronic time-switching apparatus is possible despite the presence therein of components which are partly sensitive to alterations in geometrical dimensions. The phantom representation also shows how the pot-shaped cover 152 is invertedly secured to the lower casing part with the aid of clamping jaws in the grooves with internal teeth 166.

Figure 4A:
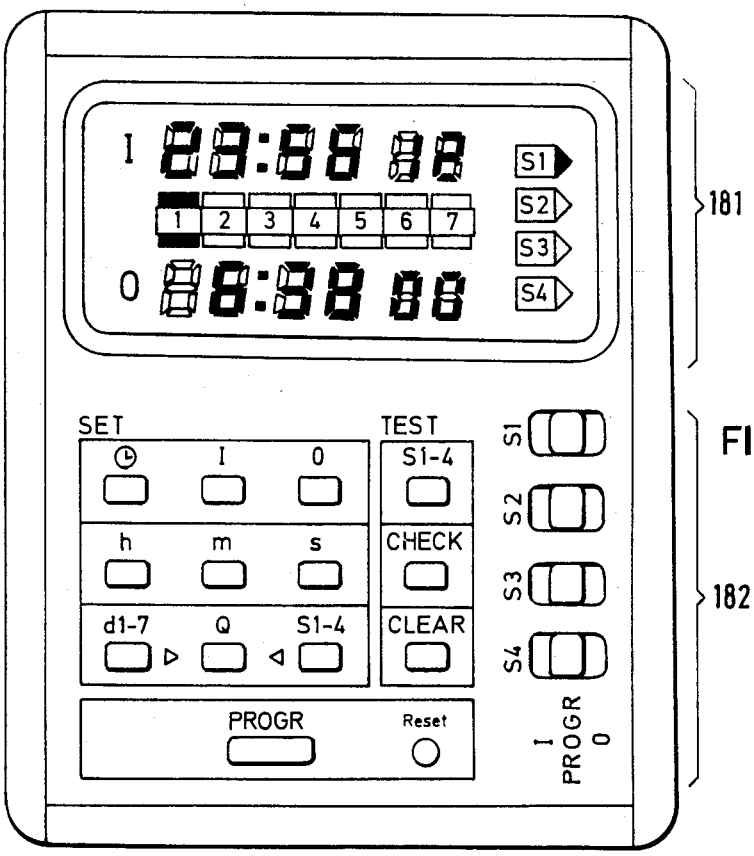
FIG. 4*a* shows a variant of the front view with a different casing configuration and different layout of keys and switches with display and operating fields vertically adjoining and of matching widths, but otherwise having the same electronic equipment as in the embodiment of FIG. 1*a* (hours, minutes, seconds, four channels)

In FIG. 4*a* there is illustrated a variant of the front view of a different form of housing on which the display and operating fields 181, 182 are arranged one above the other with their longitudinal edges adjoining (in a purely conceptual sense). Otherwise the description given with reference to FIG. 1*a* applies here also, i.e. with regard to simplification of operation on account of the geometric allocation of display-field areas and switches or keys according to rank, and especially the incrementation of the displayed values for each keying or with longer depression by a sequence, with ongoing sequential switching of both the days of the week and the channels for each key actuation, as well as the transfer into the program memory only after actuation of the confirmation key in the same manner, so that further explanations thereof are considered superfluous. The electronic outfitting and in consequence the equipment of the front plate—apart from the spatial disposition—agree with those of FIG. 1*a*.

Figure 4B:
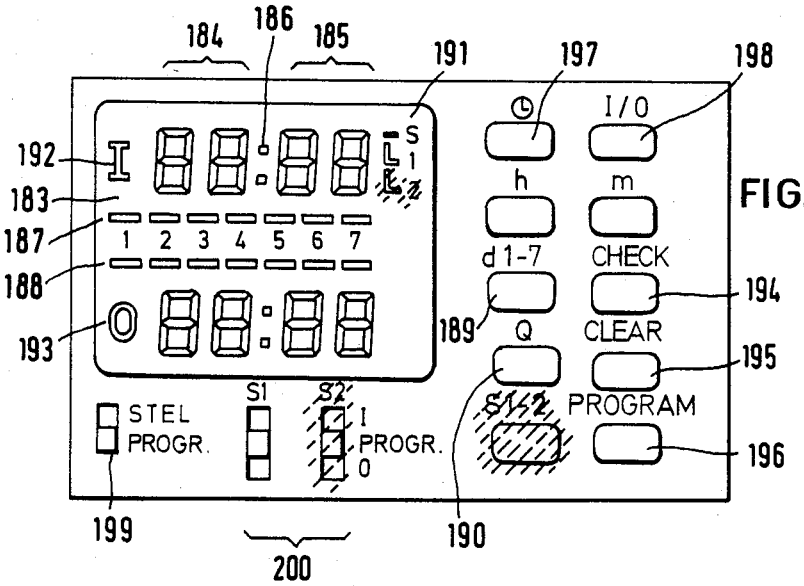
FIG. 4*b* is an elevational view of a front-plate configuration similar to that of FIG. 1*a* but with electronic equipment simplified relatively thereto, i.e. for a time display of hours and minutes and colons blinking in a one-second rhythm, and for a maximum of two channels (for a single-channel modification the elements with dotted markings are omitted)

An embodiment of the invention that has been electronically simplified by comparison with FIGS. 1*a* and 4*a* is presented in the front-view illustration of FIG. 4*b*. The digits of the display 184, 185 of the switch-ON time and, correspondingly, those of the switch-OFF time respectively show the hours and the minutes while the colons 186 disposed between them show the seconds or other fractions of the minutes. The bars 187, 188 above and below the row of digits "1 . . . 7" show with steady luminosity the day of the week selected by keys "d1-7" (189) and permanently stored in the memory by actuation of the confirmation key "Q" (190) whereupon the adjacent bar flashes on actuation of the key "d1-7" and advances one step at a time until the respective day is permanently stored in the memory, this being indicated by continuous illumination when acknowledged by the key "Q" (190). The symbols "S", "L", "1" and "2" (191) appertain to the switching channels, while the symbols "I" and "O" (192, 193) indicate the chosen partial data package for the setting of the switch-ON and switch-OFF times.

The stored switching times are scanned by the key "Check" (194), the scanned switching time is canceled by the key "Clear" (195), the (complete) data package as shown in the switching-time picture in the display is transferred into the working memory by actuation of the key "Program" (196), the key "Clock Image" (197) serves for the setting of the clock time which advances continuously in the background, the key "I/O" (198) serves for the choice between the times of "ON" and "OFF" switching, as well as for the start of operation of the timer for setting and automatic operation, and the switches 199 and 200 serve for selective operational or channel switching to "Setting/Program" or "Automatic/Independent". The parts crossed out by dotted lines are absent in the single-channel version of the timing or time-programming apparatus.

Figure 5A:
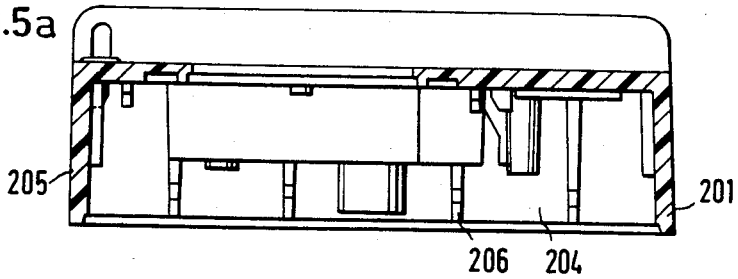
FIG. 5*a* is a cross-section along line G-H of FIG. 2*e* through the upper casing part.
Figure 5B:
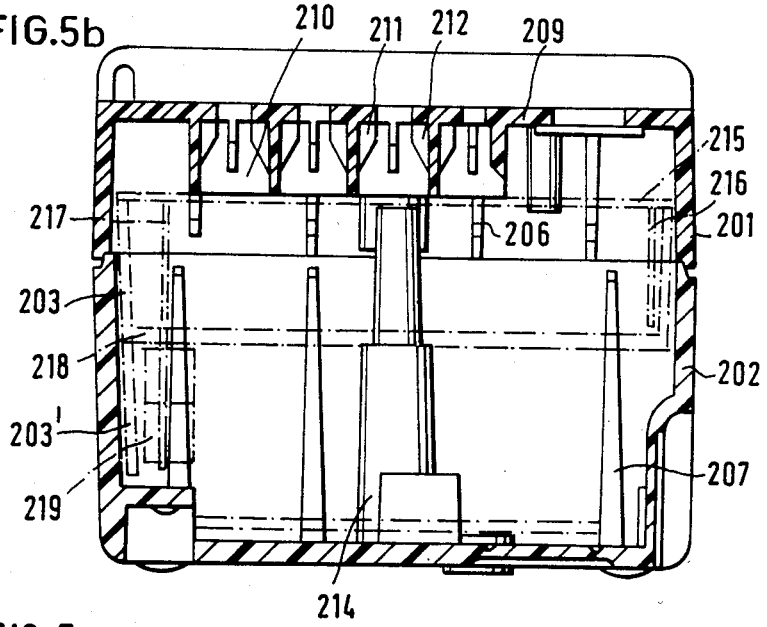
FIG. 5*b* is a cross-section along line E-F of FIG. 2*a* showing the pot-shaped cover in place and phantomized installation of the circuit board.
Figure 5C:
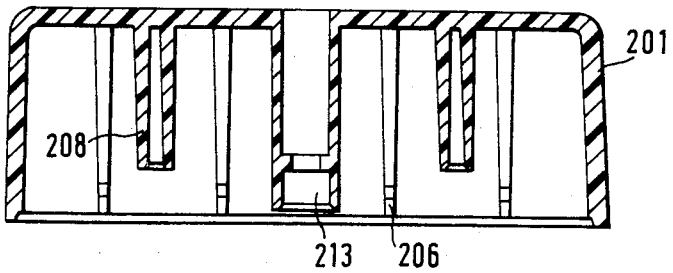
FIG. 5*c* is a cross-section along line I-K of FIG. 2*a;*

The cross-sections G-H, E-F and L-O in FIGS. 5*a*, 5*b* and 5*c*, through the upper casing part 201, with that of FIG. 2*b* supplemented in nearly conventional drafting style by the inserted cover 202 and in phantom by the internally inserted lower casing part 203, 203', illustrate in particular the various ancillary supporting, retaining and clamping means in the form of ribs 206, stays 207, 208 etc., integrally molded on in the front walls 204 or the sidewalls 205 of the casing, as well as the grid of reinforcing ribs 210 and guide ribs 211, 212 integrally molded on the underside of the front plate 209, and the recess 213 for the screw socket 214, likewise integrally molded on the cover 202. The circuit board 215, together with its lateral circuit boards 216, 217, is clamped with correct spacing and attitude between the upper casing part 201 and the lower casing part 203 with the help of ribs, e.g. 206 and 210. One of the lateral circuit boards, on the part thereof projecting above the floor, is provided with a connecting-plug strip 219.

The lower casing part (151 in FIG. 3) is shown in FIGS. 6*a*, 6*b* and 6*c* in a bottom view, a longitudinal view (section line E-F) and a top view, respectively. Notable is its split-level shape which, on the one hand, affords in the compartment 221 a larger space for the power supply whereas the elongate compartment 222 provides space for connecting-plug strips, means for connecting the installation, and the lower compartment 225 suffices for the larger components such as electrolytic capacitors, batteries and relays, while, on the other hand, the circuit board with the plug strip projects through the slot 223 in the intermediate floor 224. The grooves 226, 227, with offset toothed inner surfaces 228, and the integrally molded-on sockets 229, 230 for the screw-coupling to the upper casing part, are disposed on the sidewalls. The spacer rods 231, 232 for the self-adjustment of the distance and the position of the cover are likewise integrally molded on the underside of the intermediate floor 224.

Figures 7A, 7B, 7C, 7D, 7E, 7F:
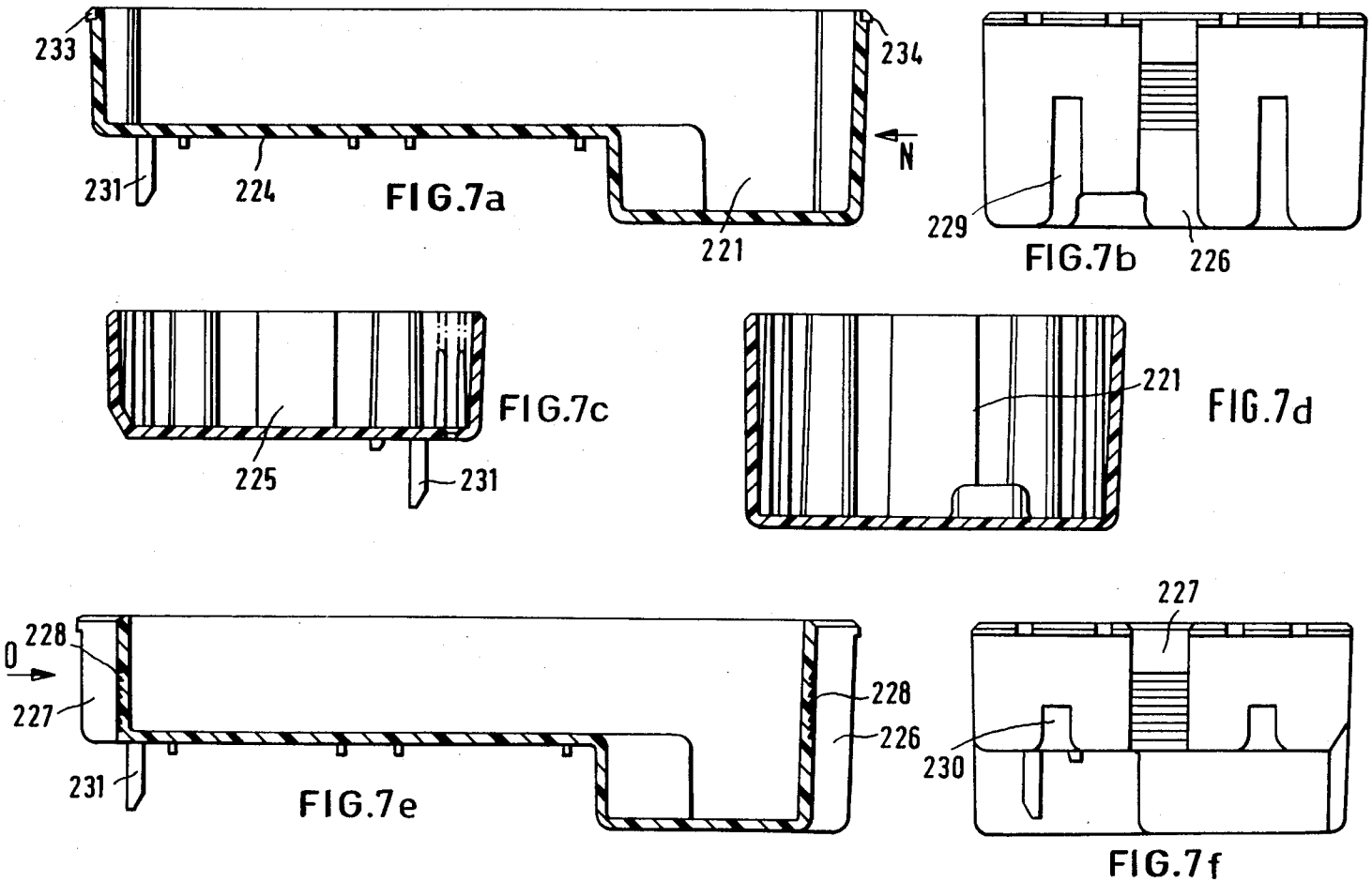
FIG. 7*a* is a longitudinal section, along the line A-B of FIG. 6*c*, through the lower casing part.
FIG. 7*b* is a side view of the lower casing part in the direction of the arrow N of FIG. 7*a;*
FIG. 7*c* is a cross-section of that part, along line I-K of FIG. 6*c;*
FIG. 7*d* is a cross-section thereof along line G-H of FIG. 6*c;*
FIG. 7*e* is a longitudinal section along line C-D of FIG. 6*c;*
FIG. 7*f* is a side view of the lower casing part in the direction of the arrow O of FIG. 7*e;*

The lower casing part (151 in FIG. 3) is again represented in FIGS. 7*a* to 7*f* wherein: FIG. 7*a* is a longitudinal section along the line A-B of FIG. 6*c*; FIG. 7*b* is a side view in the direction of the arrow N in FIG. 7*a*; FIG. 7*c* is a cross-section along the line I-K of FIG. 6*c*; FIG. 7*d* is a cross-section along the line G-H of FIG. 6*c*; FIG. 7*e* is a longitudinal section along the line C-D of FIG. 6*c*; and FIG. 7*f* is a side view in the direction of the arrow O in FIG. 7*e*. The particulars are the same as given for FIG. 6 so that further explanation thereof is unnecessary.

Figure 8C:
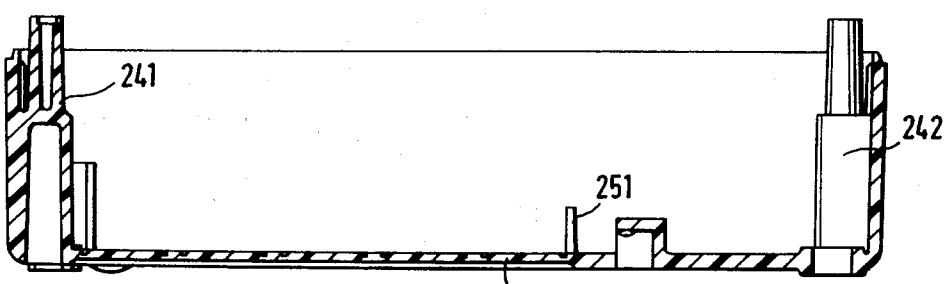
FIG. 8*c* is a cross-section along line L-O of FIG. 8*d;*
Figure 8D:
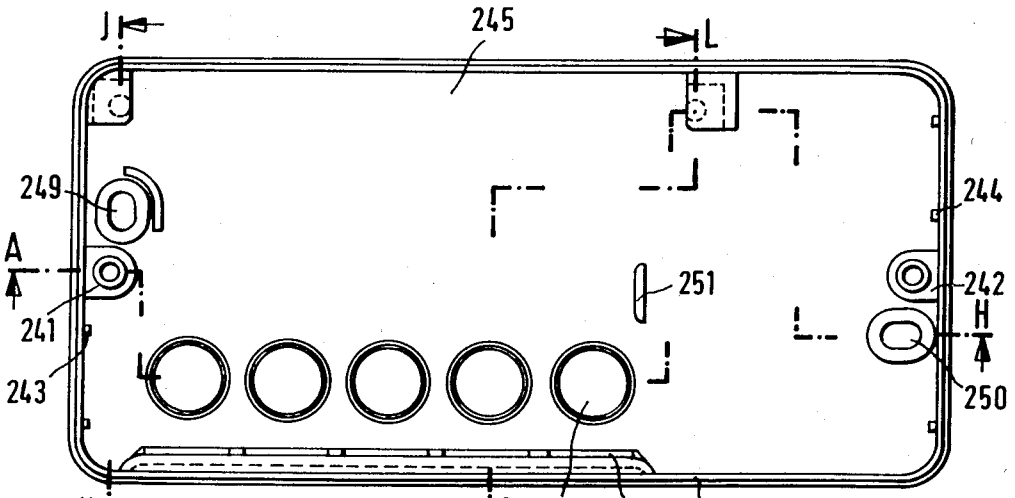
FIG. 8*d* is a plan view of the interior of the cover.
Figure 8A:
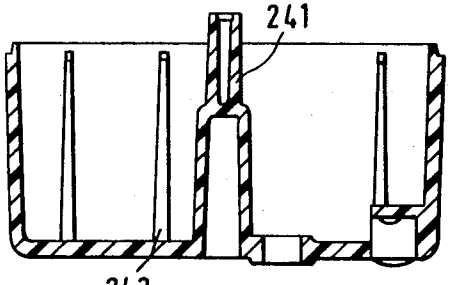
FIG. 8*a* is a cross-section, along the line J-K through the pot-shaped cover of FIG. 8*d;*
Figure 8B:
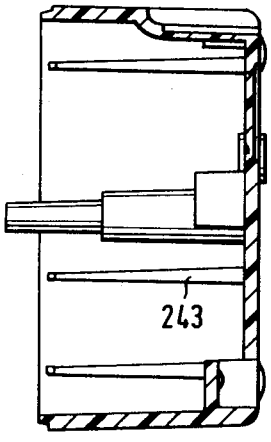
FIG. 8*b* is a longitudinal section along line A-H of FIG. 8*d;*
Figure 9A:
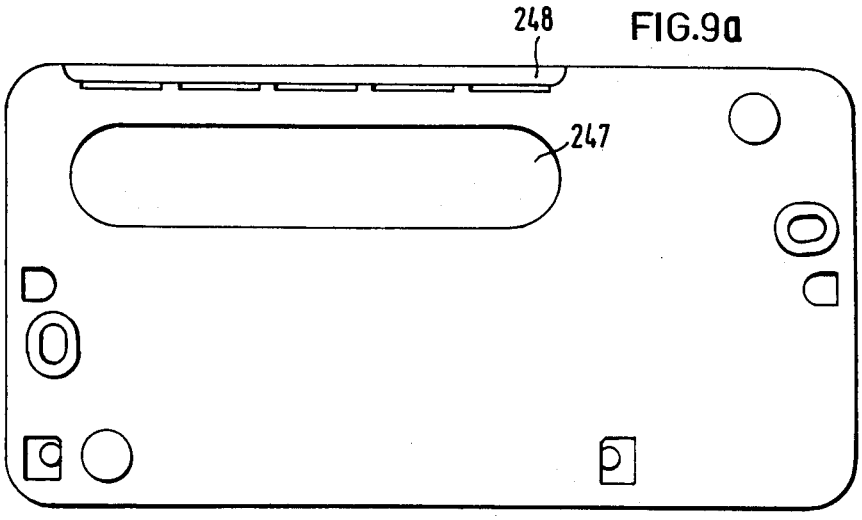
FIG. 9*a* is a bottom view of the cover.
Figure 9B:
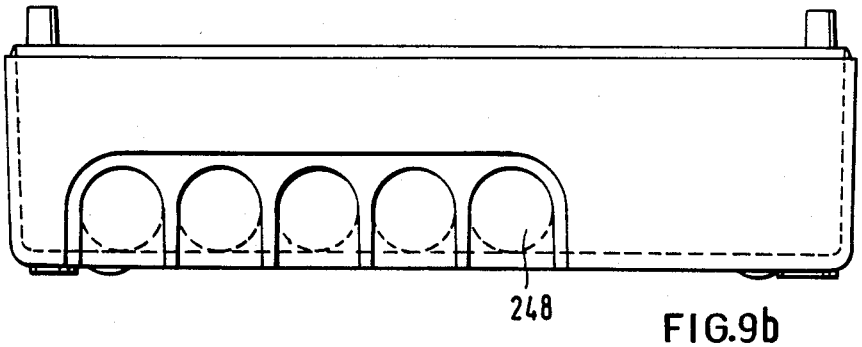
FIG. 9*b* is a front view of the same.

The cover (202 in FIG. 5*b*) is illustrated in various representations in FIGS. 8 and 9 as follows: FIG. 8*a* is a cross-section along the line J-K of FIG. 8*d*; FIG. 8*b* is a longitudinal section along the line A-H of FIG. 8*d*; FIG. 8*c* is a cross-section along the line L-O of FIG. 8*d*; FIG. 8*d* is a plan view of the interior; FIG. 9*a* is a bottom view; and FIG. 9*b* is a front view. The screw sockets (214 in FIG. 5*b*) are designated 241, 242 in FIGS. 8*c*, 8*d*; integrally molded-on ribs, e.g. 243, 244, see FIGS. 8*a*, 8*b*, 8*d*, are disposed on the sidewalls for the support of the sidewalls of the lower casing part (FIGS. 6 and 7) on the lugs (233, 234) on the upper edge thereof. Frangible aperture surfaces 247 or 248, 249, 250 for connecting lines and assembly are provided in the floor 245 and in the front wall 246. Further integrally molded-on parts are e.g. the fitting members 251 for the lower casing part.

Figure 10:
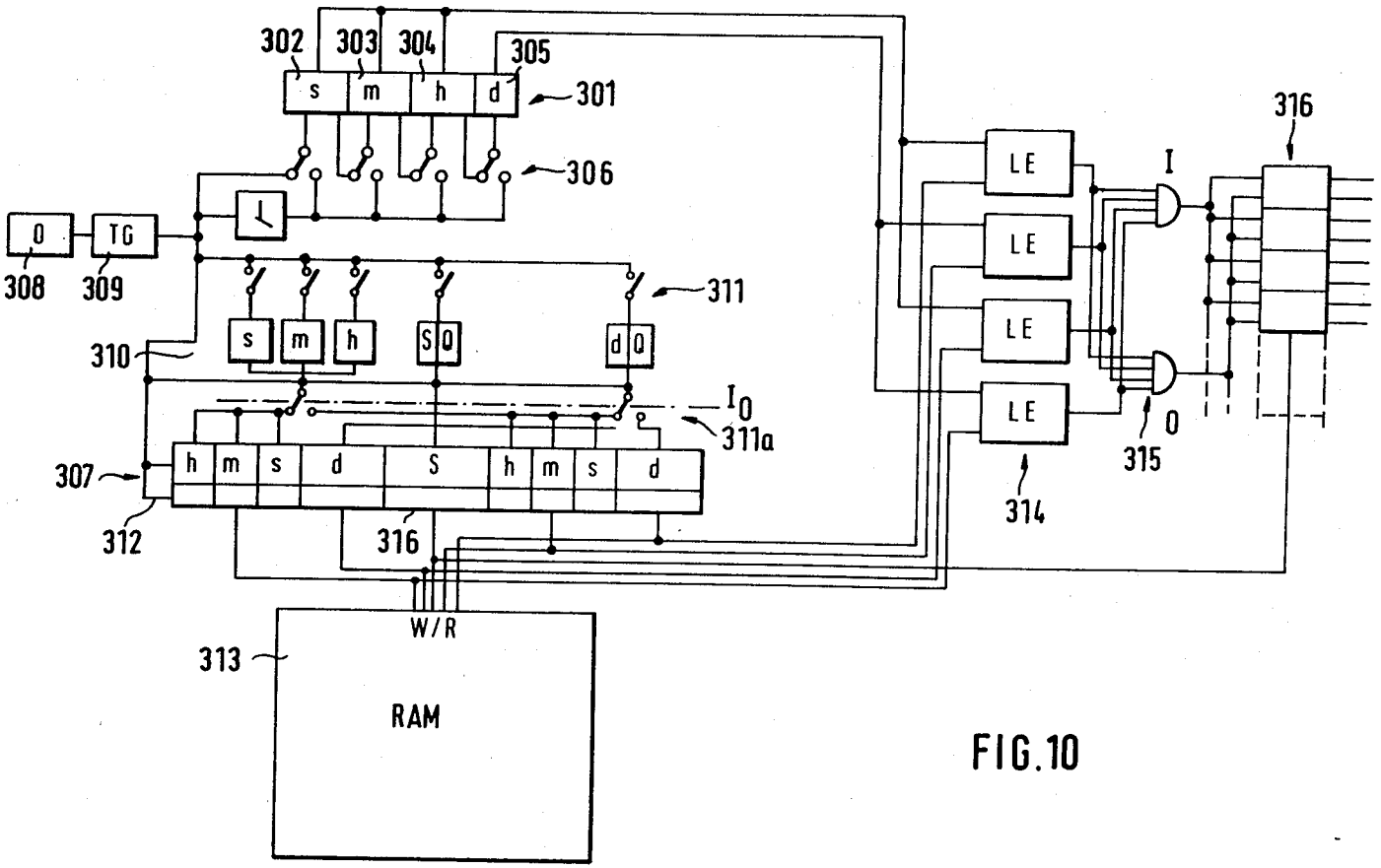
FIG. 10 is a greatly simplified block diagram showing the most important electronic components.

There now follows a description of the circuitry features with reference to FIGS. 10 to 14. To begin with, FIG. 10 represents a greatly simplified block diagram with the most important electronic components. There the intermediate memory 301 has sections 302 to 305 for the time of day, which are connected as continuous counters with stages 60(*s*), 60(*m*), 24(*h*) and 7(*d*) and are settable in the nonillustrated position of the switches 306 to the actual time of day from the intermediate memory 307 by means of a data package which has been read into same; the electronic clock (intermediate memory 301) can be continuously fed from the frequency-divider pulse source controlled by an oscillator 308, and, likewise, the sections of the intermediate memory 307 can be loaded section by section from the program memory 310, with its sections set by actuation of the setting-key switch 311 and with the changeover switch 311*a* set to either switch-ON time or switch-OFF time, by means of timing pulses from the pulse generator 309. Two half data packages from the program memory can be stored in the intermediate memory 307, depending on the setting of the changeover switch 311*a*, thus with positions "I" and "O", in that or the reverse sequence. The intermediate memory 307 can be connected with the input memory 312 of a display device and with the working memory 313 via the conductor group 314.

During automatic operation a complete data package is transferred from the working memory into the intermediate memory 307 while in the display device the current time of day is being indicated by the latter and one of the two half data sets for switch-ON time and switch-OFF time lie in sections at the inputs of the logic comparator units 314 which, in the presence of equality, send a signal to their outputs by way of the controlled logic AND elements 315—not illustrated individually—for all sections of the circuitry, and, together with the signal of the channel-selection section 316, switch to the ON or OFF operating condition.

Figure 11:
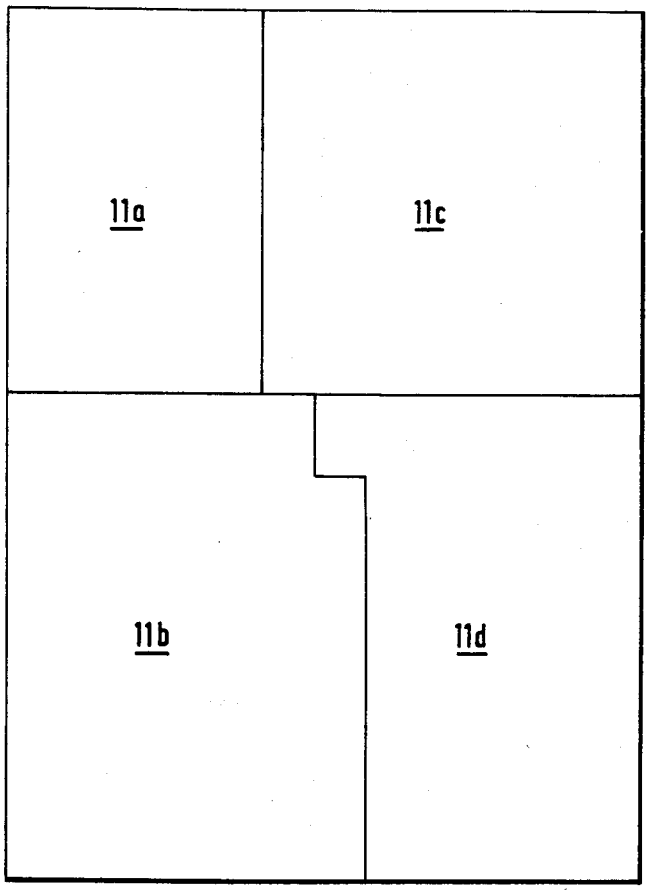
FIG. 11 is a schematic representation of the subdivision of the overall block diagram with parallel-logic junction stages and the interrelationship of the partial block diagrams 11*a* to 11*d;*

FIG. 11 shows a schematic representation of the subdivision of the overall block diagram with parallel-logic junction stages and the interrelationship of the partial block diagrams 11*a* to 11*d*.

Figure 11A:
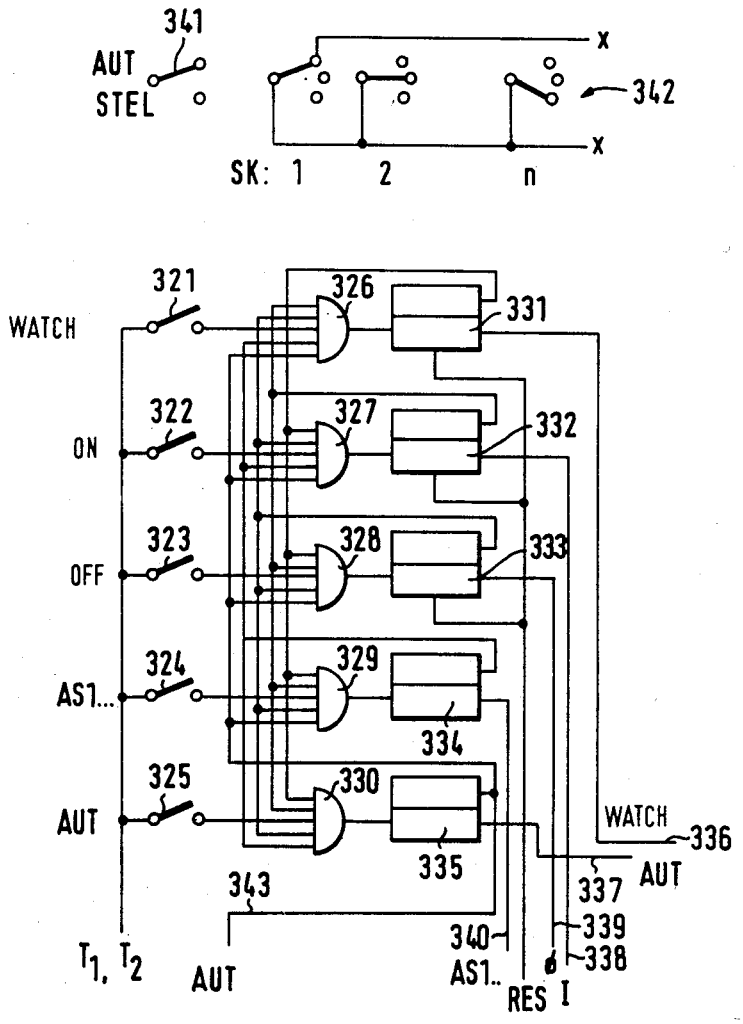
FIG. 11*a* is a block diagram of the correspondingly labeled subdivision in FIG. 11, showing the sub-assembly with the function-selection keys.

The sub-assembly of FIG. 11*a* with the function-selection keys 321 (WATCH) for the current clock time, 322 (ON), 323 (OFF) for the switch-ON and switch-OFF times, 324 (ASI . . . ) for the channel-scan preselection and 325 (AUT) for switchover to the automatic operation of the electronic timing apparatus are connected on one side to the pulse source $T_1$, $T_2$—as described subsequently—and are connected on the output side via the AND-elements to the complementary outputs $\overline{Q}$ of the FLIP-FLOP members 331 to 335 of the respective other function-selection keys. This has the result that the FLIP-FLOP element (e.g. 332) controlled by actuation of a key (e.g. 322) blocks by its $\overline{Q}$ output the inputs of all other FLIP-FLOP elements, 331, 333, 334 and 335 by means of the not-enabled AND-elements 326, 328, 329 and 330.

Thus, H signals remain on the output lines 336 (WATCH), 337 (AUT), 338 ("I") and 339 ("O"), as well as 340 (AS1 . . . ) so long as no function-selection key other than that of the set FLIP-FLOP member has been actuated. The main function-selection switch "AUT/-STEL" 341 is connected to some point of the circuitry whereby the same output effect is achieved—although blocked—as with the "AUT" function-selection key 325. The switching-channel setting switches 342 serve for blocking the control circuit of the switching devices in one of these operating conditions: permanently ON, permanently OFF or permanently disabled.

Figure 11B:
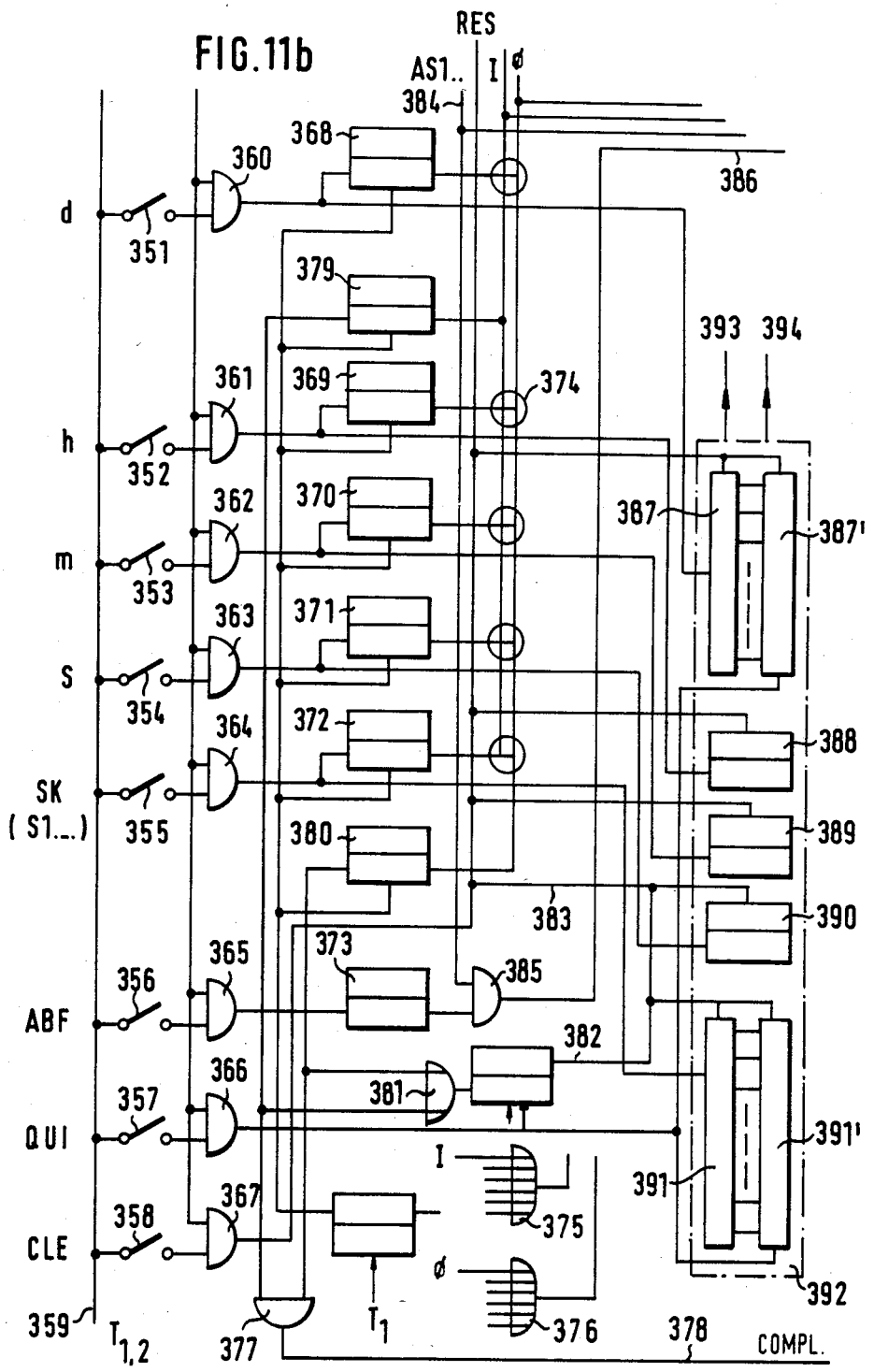
FIG. 11*b* is a block diagram of the correspondingly labeled subdivision in FIG. 11, showing the sub-assembly with the setting keys and the programming memory.

The sub-assembly of FIG. 11*b* with the setting keys 351 (day of the week "d"), 352 (hour "h"), 353 (minute "m"), 354 (second "s"), 355 (switching channel "S1 . . . "), 356 (scanning "ABF"), 357 (confirmation "QUI", i.e. transfer of the switch setting for the day of the week or the switching channel) and 358 (cancellation "CLE") is connected on one side to the timing pulse source by way of the line 359 and is connected to either $T_1$ or $T_2$—as will be further described below—and is connected by its output to a respective input of AND-elements 360 to 367 while the other input is connected to the $\overline{Q}$ output (343 in FIG. 11*a*) of the respective FLIP-FLOP member 335 which is assigned to the function-selection key 325 "AUT". Thus, in automatic operation, all setting keys of this group 351 to 358 are blocked inoperative. The outputs of the AND-elements 360 to 365 control the monostable FLOP members 368 to 373 which deliver signals for further connections.

The set outputs of the monostable FLOP members 332, 333 (FIG. 11*a*), as shown by circles, e.g. 374, are interconnected by OR-members 375, 376 so that they indicate by output signals via FLIP-FLOP members 379, 380 whether all the relevant setting keys are operated; only then is a H signal emitted for the setting routine "ON", as well as for the routine "OFF", and is forwarded by way of the AND-element 377 to the line 378 for a positive result of the completion check. These output signals, by way of an OR-element 381, also control a time-delayed monostable FLOP member whose complementary $\overline{Q}$-output signal 382 appears on the reset line 383 for the resetting inputs. The "ABF" key 356 effects the transfer of a data package, stored in the working memory, into the input memory of the display device, and thereby an interruption of "AUT" routine, only if the "AS1 . . . " function-selection key has previously been actuated, i.e. a signal is present on the line 384 and enables the forwarding of the "ABF" signal by way of the AND-element 385 to the line 386.

The actual setting signals to from the respective output of one of the AND-elements 360 to 364 to the individual assigned sections of the intermediate memory 387 to 391 and set same to the corresponding values of the program memory according to the number of clock pulses fed in; the intermediate-memory sections 387 and 391 are constructed as shift registers, so that after each entry, which is to remain stored, the latter has to be fed into the register 387' or 391' proper—possibly in addition to any places already occupied therein—by means of a signal at the output of the AND-element 366 which belongs to the confirmation setting key "QUI" 357. The data contents of the sections, "switching time" and "switching channel" are read out at the outputs 393 or 394 of the program memory.

Figure 11C:
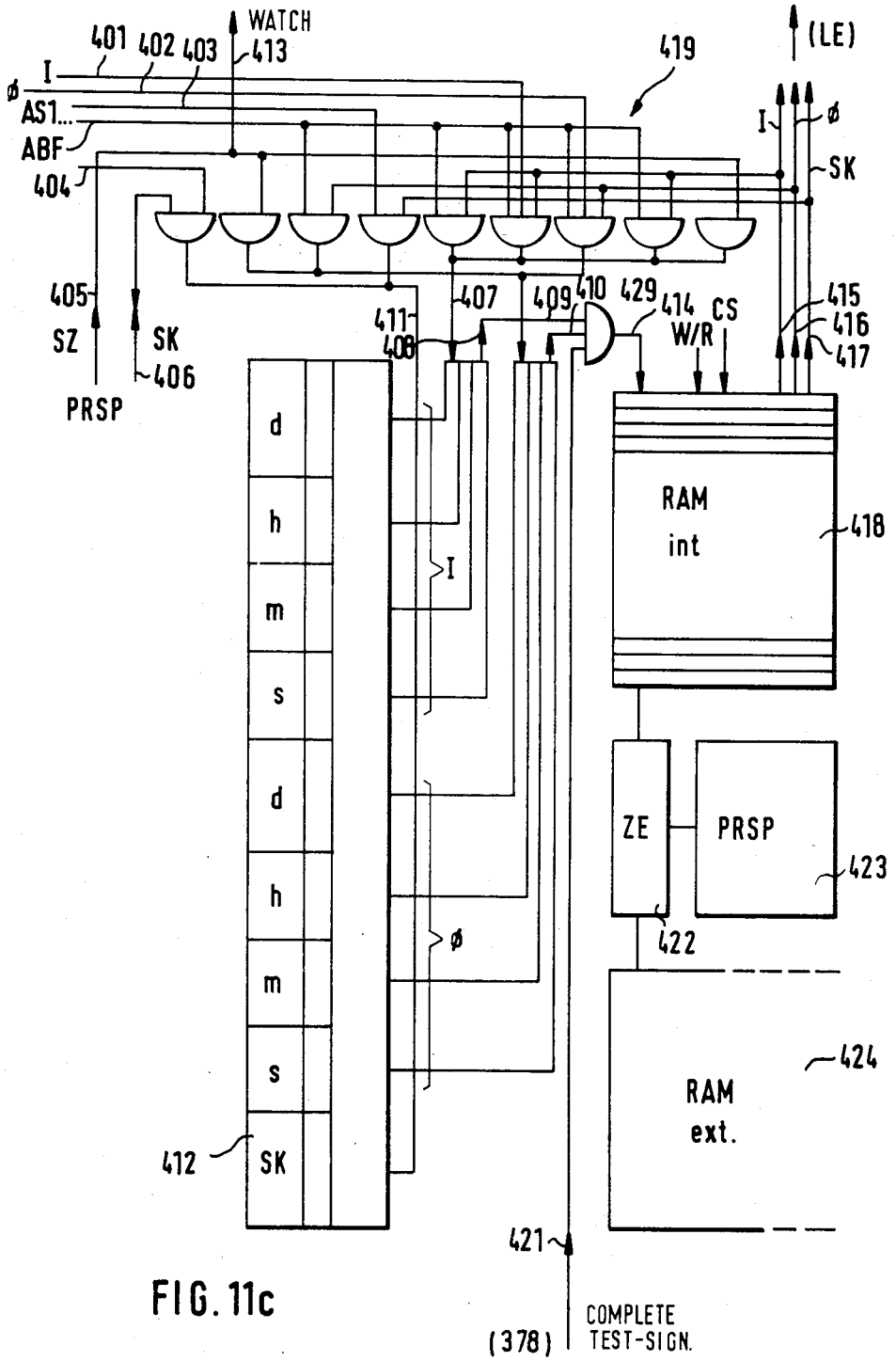
FIG. 11*c* is a block diagram of the correspondingly labeled subdivision in FIG. 11, showing the sub-assembly with the AND-junction group for the inputs and outputs of the input memory of the display device.

As shown in FIG. 11*c*, the function-selection signals "I", "O", "AS1 . . . ", 401 to 403, and the setting signal "ABF" 404 are logically interconnected with the outputs "SZ" (switching times) 405 and "SK" (switching channels) 406, with the inputs and outputs of the intermediate memory 412 for the complete data package 407, 408 for switch-ON time and 409, 410 for switch-OFF time, and with switching channel 411, by means of a chain 419 of AND-elements and the AND-element 430, the latter together with the completion signal on line 421 (378 in FIG. 11*b*). Likewise the input of the electronic clock 413 and the input 414, as well as the outputs 415 (switch-ON time), 416 (switch-OFF time) and 417 (switching channel) of the working memory "RAM" 418 are interconnected by the same chain of AND-elements. The data transfers relative to the working memory 418 are governed by the central unit "ZE" 422 including decoder in conjunction with a program memory "PRSP" 423 and, possibly, with an external additional read/write memory 424.

Figure 11D:
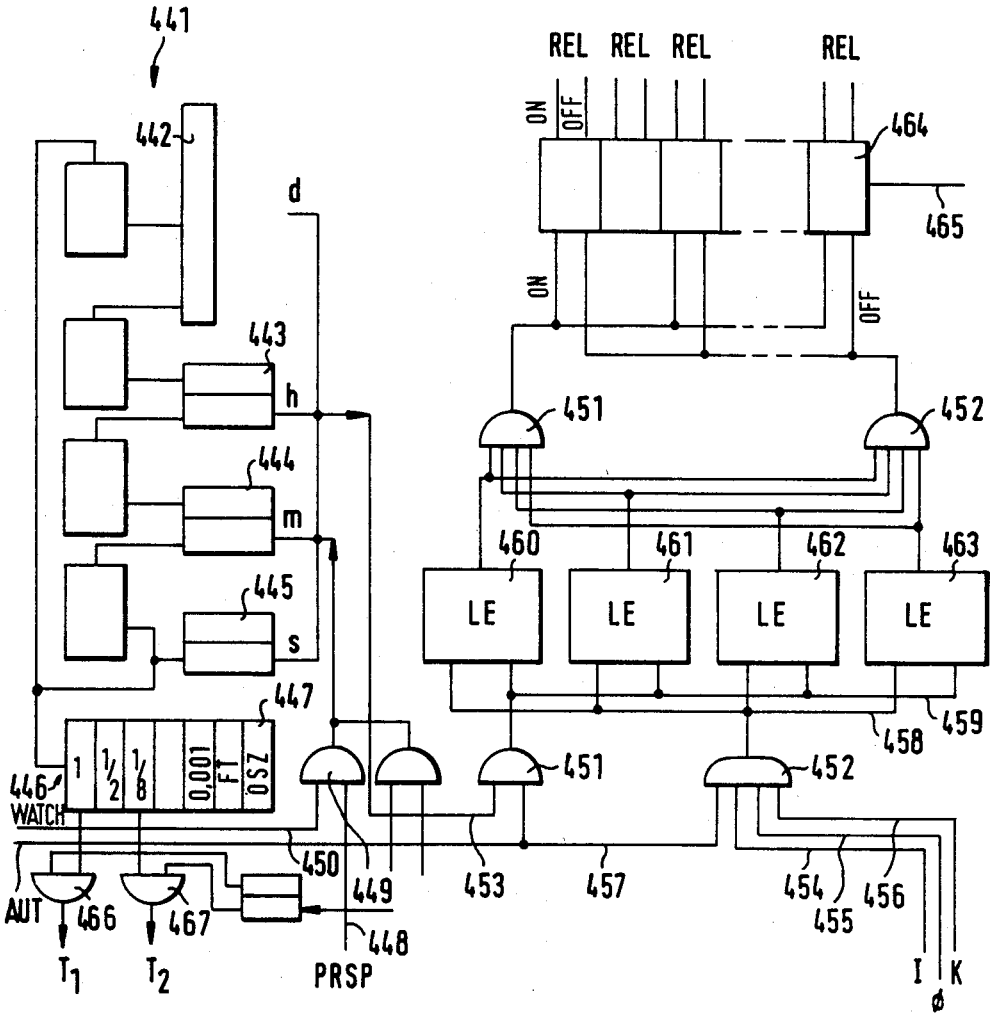
FIG. 11*d* is a block diagram of the correspondingly labeled subdivision in FIG. 11, showing the sub-assembly with electronic clock and logic units (LE) with associated AND-junction members.

FIG. 11*d* illustrates the components of the electronic clock 441 with the time-segment stages—designed as counters—442 (day of the week "d"), 443 (Hours "h"), 444 (minutes "m") and 445 (seconds "s"), with the clock-pulse generator 446, consisting of an oscillator 447 and various divider stages, e.g. $T_1$ and $T_2$, inter alia for 1-ms, ½-s, ⅛-s, 1-s timing-signal outputs, as well as (1 s) for the continuous advance of the electronic clock 441. The time-segment stages 442 to 445 can also be set from the program memory (392 in FIG. 11*b*) by way of the line 448 and the AND-element 449, in the presence of the function-signal WATCH on the line 450.

Two different clock signals are alternately and transposedly sent, after a time interval, to outputs $T_1$–$T_2$ by the clock-pulse generator 446 by way of the AND-elements 466, 467, by controlling the second inputs from a monostable FLOP member controlled with time delay via the line 448. This arrangement produces the time-delayed switchover of the clock-signal entry at the setting keys from single pulses to a succession of faster clock pulses. Also shown in this arrangement are associated AND-elements and lines 451–459, comparators "LE" 460–463 and registers "REL" 464, 465.

Figure 12:
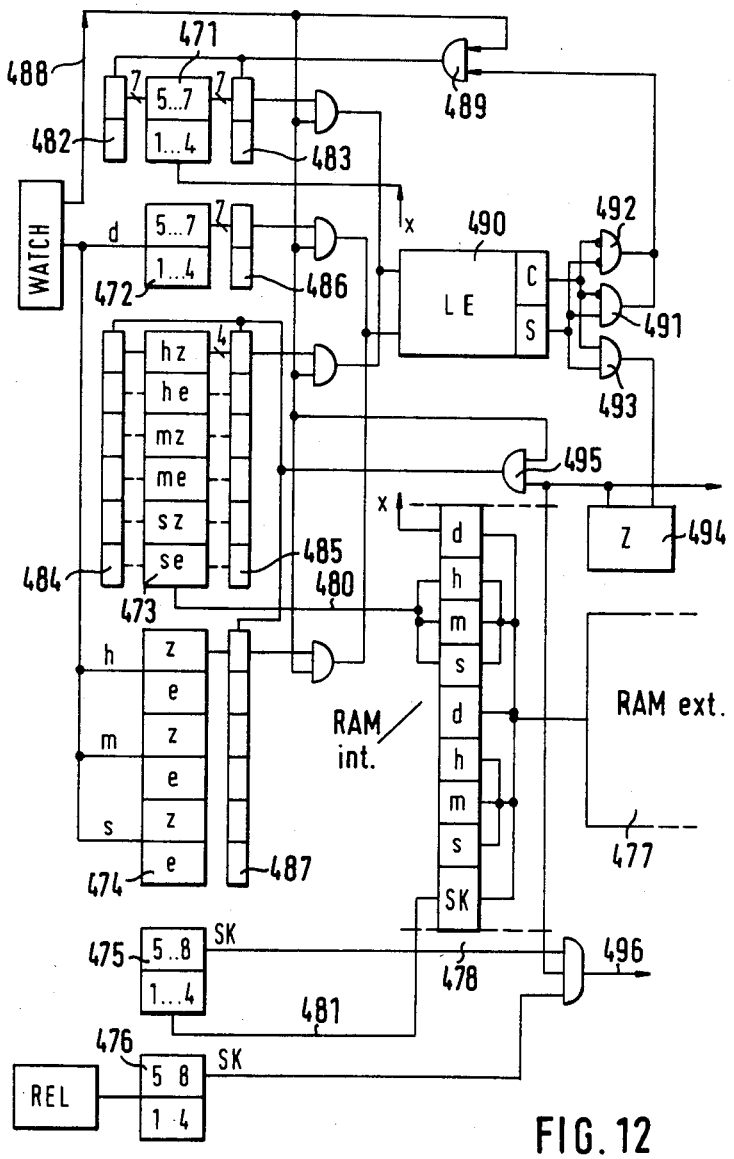
FIG. 12 is a schematic block-diagram section from an example of series-logic junction stages with shift registers in the comparison of data-package sections.

The schematic block diagram of FIG. 12 is a section which shows an example, with serial-logic junction stages, for the comparison of data-package sections with use of shift registers in processing the time comparison of clock time and programmed switch-ON and switch-OFF time. The relevant data and half-data packages are written in the registers 471 and 472 for the days of the week, 473 and 474 for "h", "m" and "s", in each instance for the actual clock time and the stored switching time, respectively, and in registers 475 and 476 for the switching channels of an intermediate memory 478 loaded from the working memory "RAM" 477 by way of lines 479, 480 and 481. Shift registers 482 to 485 and 486, 487 are respectively allocated to the registers 472, 473 of the switching times on the input and output sides and to the registers for the switching channels on the output side only. On the occurrence of any clock pulse the shift registers switch the input and, as the case may be, the output of the corresponding time segment register to the next one.

The clock pulses are emitted through multiple interconnections by means of AND-elements between clock-signal line 488 by way of a first AND-element 489, with the AND-elements—one unilaterally negated 491 and one bilaterally negated 492—controlled by CARRY "C" and STATUS "S" output signals of the comparator stage "LE" 490. When, on the next clock pulse, the comparator member 490 ascertains equality, and CARRY and STATUS outputs are at H, the AND-element 493 is enabled and a clock pulse is imparted to the further shift registers 484, 485 and 487 by way of the counter "Z" 494 and the AND-element 495, so that the comparison is made available for the next section. If the comparator stage 490 emits the STATUS and CARRY signal equal to 1 (H) also in this case, then the memory sections for the switching channels which have been found equal are switched through to the output 496 from the registers 475, 476 by way of the enabled AND-element and further control operations are initiated. Thus in this example the individual data-package sections are scanned serially, not in parallel.

Figure 13:
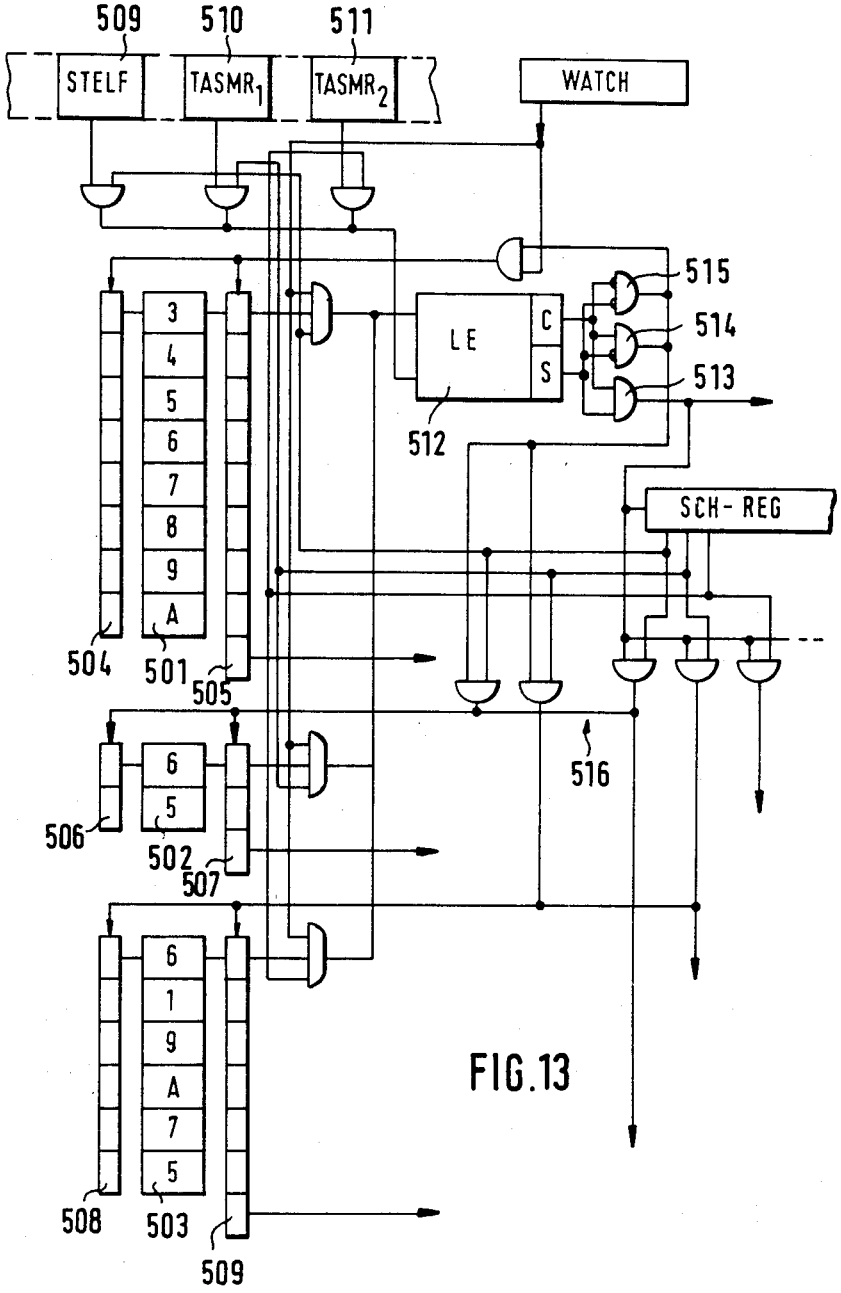
FIG. 13 is a schematic block-diagram section of an example, corresponding to the example of FIG. 12, in the evaluation of the setting-key codes.

The section of a schematic block diagram given by FIG. 13 as an example of the evaluation of the setting-key code works according to the same principle as in FIG. 12. Stored in register 501 are, e.g. the constants corresponding to the key codes for the subordinated area, namely "QUI" (3), "CLE" (4), "S1-4" (5), "DAY" (6), "SEC" (7), "ABF" (8), "HR" (9), and "MIN" (A); in register 502 for an "ABF" subroutine for the "QUI" setting key the constants—again corresponding to the key codes—for "DAY" (6) and "S1-4" (5); in a register 503 for the "ABF" subroutine for the "CLE" key the constants corresponding to the key codes for "DAY" (6), "DAYIO" (1), "HR" (9), "MIN" (10=A—sexadecimal code!), "SEC" (7), and "S1 . . . 4" (5). By means of the shift registers 504 to 508 these constants are successively compared with the key codes read out of the key-switch (or switch-contact) matrix (563 in FIG. 14), and written in the intermediate-memory spaces "STELF" 509, "$TASMR_1$" 510 and "$TASMR_2$" 511 and, according to the result of the logic comparator stage 512, the CARRY and STATUS signals are coupled unaltered, with the clock signal through AND-elements 513, 514 and 515, with one and with two negated inputs, and the register places are correspondingly advanced from stage to stage until equality is established, whereupon the procedure is continued with a subsequent register, e.g. 502, 503 etc. The output signals then control, coupled via further AND-elements 516, and a further shift register closes the signal circuit for each successive switching group.

Figure 14:
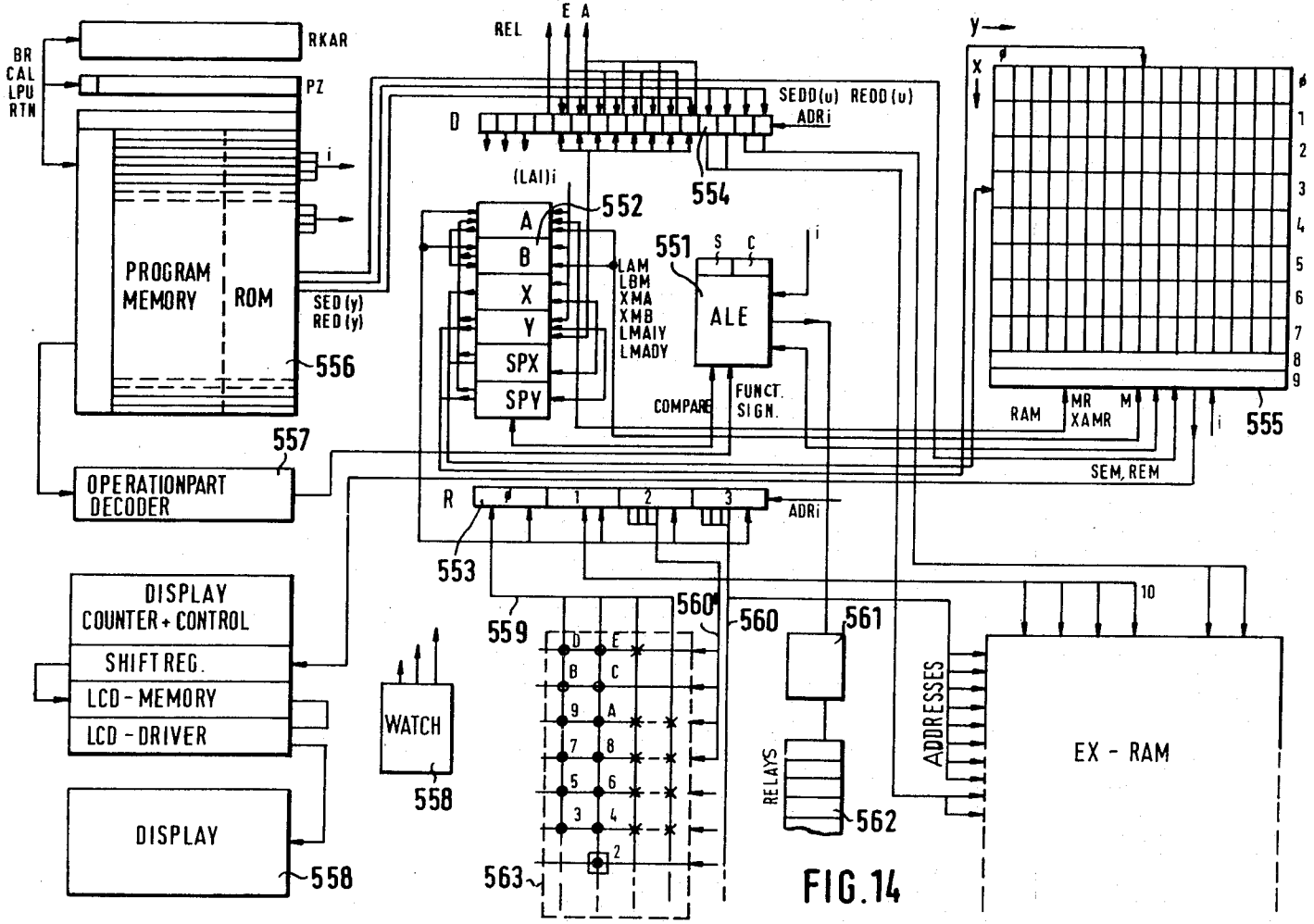
FIG. 14 is a schematic block diagram of an embodiment with an operating-field matrix for function-selection switches and keys, as well as setting keys and microprocessor with arithmetic logic unit, buffer memories, input and output registers, working memories, program memories etc.

The embodiment in FIG. 14 is equipped with a microprocessor, in which are integrated the components arithmetic-logic unit (ALE) 551, intermediate memory group 552, input and output register R 553, output register D 554, working memory 555 including program memory, intermediate memory for complete data packages, program memory 556 including program counter, return-address memory and table memory, operation-part decoder 557, and display device including ancillary components and clock 558. To the input and output register are connected reading lines 559 and address lines 560, 561 of the function-selection switches and keys, and the setting keys, assembled in a matrix 563, hierarchically in such a manner that the switch and key codes are derived from the codes of the lines so as to be distributable in areas allotted to constants, e.g. with the superior function keys "WATCH", "ON", "OFF", "ASI . . . " lying in the constant area greater than 10 (A), the subordinate setting keys "h", "m", "s", "d1-7", "S1 . . . 4", "QUI", "ABF" and "AS1 . . . " lying in the area less than/equal to 10 (A) and greater than 2, and the "AUT" key lying in the area less than/equal to 2. This procedure makes possible an unambiguous scanning in all three cases with fairly few working steps. The output signal of the logic coupling and comparator stage 551 controls the relays 562 by way of intermediate components 561 and further coupling members.

In the performance of the program, the operational portions of the command words of the program memory are processed according to the steps of the instruction counter, corresponding exactly to the serial-logic interconnection of the embodiments of FIGS. 12 and 13 which operate purely in hardware.

Figure 15:
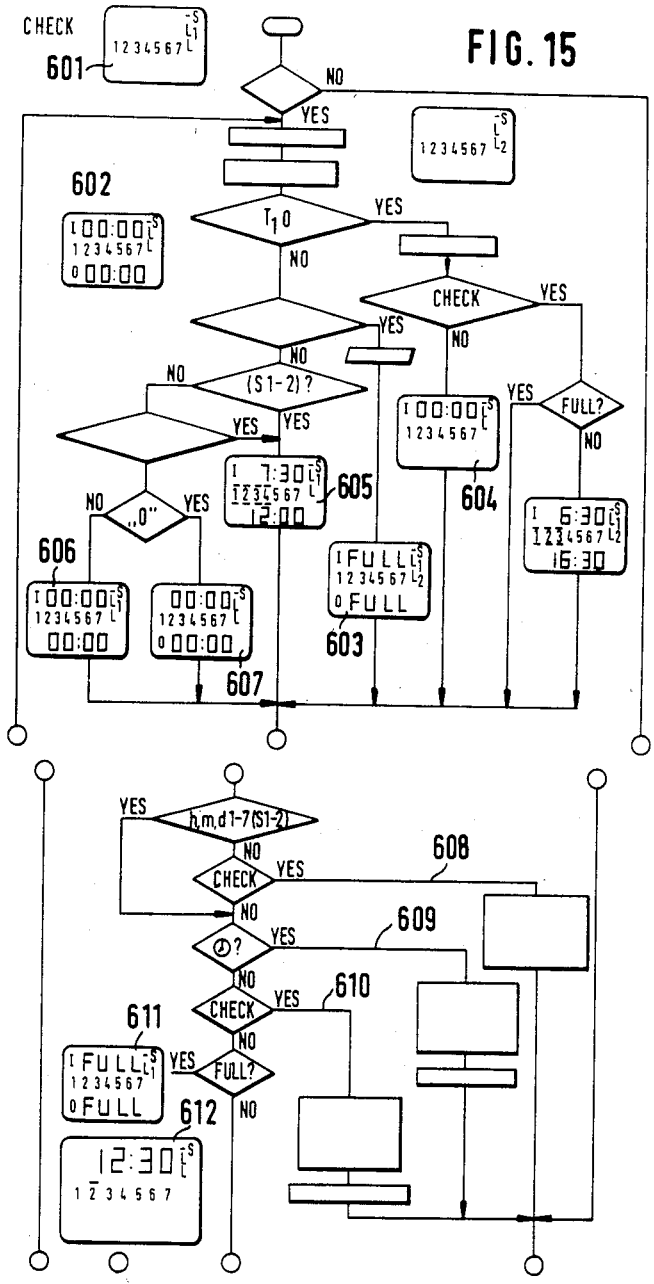
FIG. 15 shows part of a flow diagram of the embodiment of a time switch according to FIG. 4*b* with inserted luminous digit display indications for individual operating conditions, including indications of ON and OFF switching times, the instant time of day, the selected day of the week and switching channels, as well as the symbols "I" and "O" for ON and OFF switching times.

With reference to the flow diagram excerptedly reproduced in FIG. 15, the simple and clear manipulatoion of a timing or time-programming apparatus in accordance with the embodiment of FIG. 4*b* will be explained. Upon a first actuation of the key "Check" (194) there appears an empty display (601) solely with the row of digits "1 . . . 7" for the days of the week and the symbols "−S", "$L_1$" and "L" for the channels which have or have not been previously set as the case may be, with renewed actuation of the said key the first switching-time picture appears, beginning with Monday but still without its indication 00.00 hours (602). After further scanning of switching times there appears at some instant the image "FULL" (603), namely, when the storage capacity reserved for S-$L_1$ has been exhausted. Thereupon, with another actuation of the key "Check", the channel "S-$L_2$" is selected. If actuation is once again repeated until the message "FULL" appears, there is automatic switch-back to channel "S-$L_1$" and the empty display (601) reappears. Upon actuation of the key "I/O" (198) there is first displayed the switch-ON picture (604) for the first setting, here still 00.00 hours for "I".

After the first actuation of the key "I/O" followed by that of the key "Check", provided that the keys "h", "m", "d1-7" and "S1-2" had already been actuated, the switching times 605 are called up, possibly in succession. If this actuation had not yet taken place, the ON ("I") and OFF ("O") switching times can be entered (606 or 607), in accordance with the preselection by the key "I/O", by means of the keys "h", "m", "d1-7" and "S1-2". Following this, the entered switching-time data, i.e. those indicated and selected by the key last actuated, can be canceled by actuation of the key "Clear" (608) and/or, by actuation of the key "WATCH" the current clock time (609) can be displayed or set, or, alternatively, by actuation of the key "Check" the corresponding switching-time picture (610) can be called up without transfer to the working memory; when "FULL" is displayed (611) the current clock time (612) comes into the display.

FIG. 16 shows that the display, alteration and cancellation of the data of the indicated and set days of the week and switching channels take place in an equally simple manner. In every case the days of the week for the switch-ON time are shown there in the upper row and those for the switch-OFF time in the lower row, corresponding to the picture 605 on the display, as a series of lit-up, possibly juxtaposed bars, with "flashing" indicated by hatching and "constant", i.e. continuously lit, indicated in solid black. FIG. 16*a* represents at 1 the sequence of the bar images in accordance with the actuation of the keys "d1-7", possibly repeated or partly repeated, confirmaion "Q", and at 2 the resulting section of the data package for the switching time corresponding to the setting of the days of the week. FIG. 16*b* shows according to 1 how by actuations of the key "d1-7", again partially several times without confirmation, the setting of Tuesday and Wednesday is extended by the additional weekdays Thursday and Saturday, 3.

In FIG. 16*c*, 1 above, the absence of a setting of ON-switching days is displayed, which is eliminated by two actuations of the key "d1-7" according to 2 and actuation of the key "Q". In FIG. 16*d*, row 1, flshing of all bars shows that no days of the week at all has been set, for which reason, according to 2, the data-package section for the days of the week must be corrected by key "I/O"—setting to ON, i.e. "I"—and by actuation of the keys "d1-7" and "Q" followed by 3 reversal of the key "I/O"—setting to OFF, i.e. "O"—and, likewise, actuation of the keys "d1-7" and "Q". It is just as simple to remove an erroneous setting according to FIG. 16*e*—here more ON-switching days than OFF-switching days in row 1—by preselection of the switch-OFF times "O" by means of key "I/O" and actuation of the keys "d1-7" and "Q" for the setting of the weekdays Monday, Tuesday, Wednesday and Friday and confirmation thereof for storage.

FIG. 16*$f_1$*, row 1 shows an incomplete entry of the switching channels ("S-$L_1$" only) which is complemented to that of row 2 by actuation of the keys "S1-2" and "Q", as can be seen from the sequence of the key diagrams. In the case of the erroneous setting according to row 1 of FIG. 16*$f_2$* to the second switching channel, actuation of the key "S1-2" switches over to the first switching channel, with the symbol flashing, whereupon this correction can be stored by actuation of the key "Q".

Figure 17:
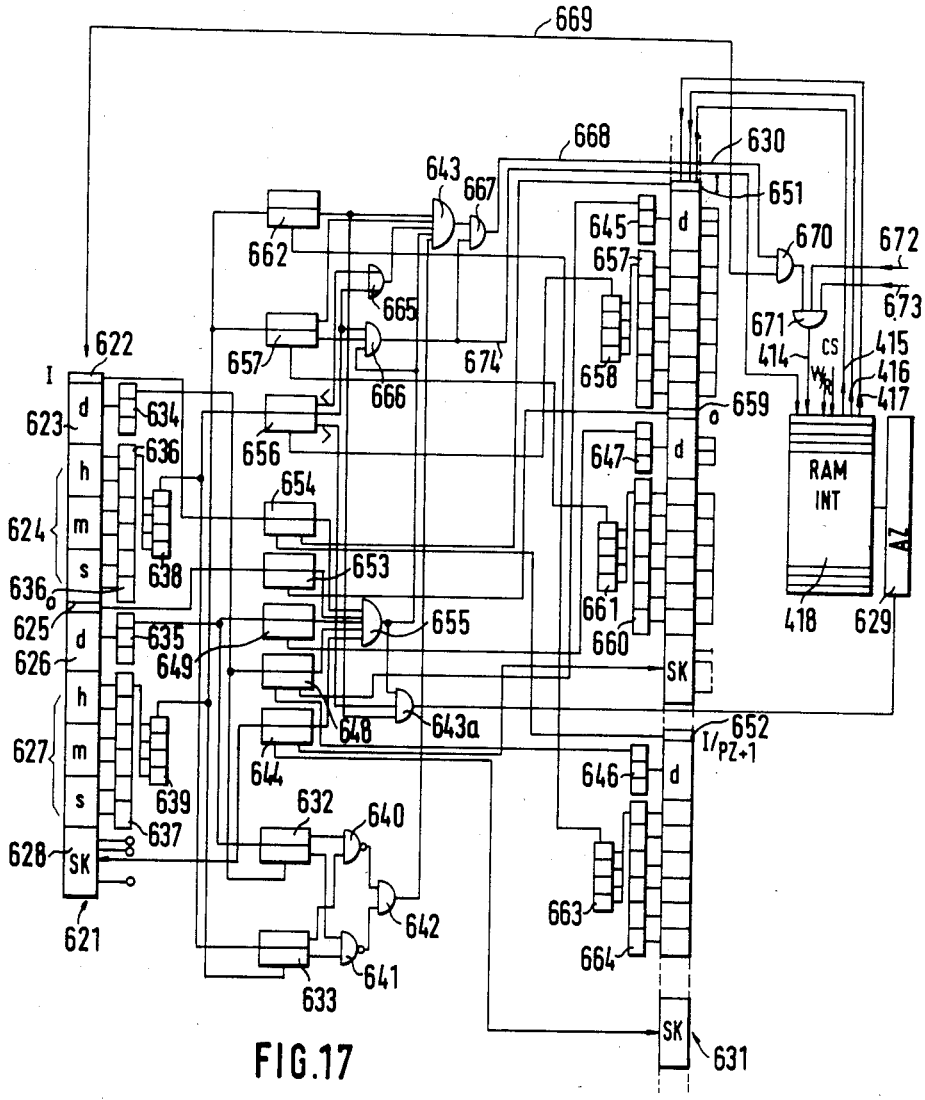
FIG. 17 is a block diagram of an embodiment for the testing of compatibility (plausibility) of the entered data of a complete set-point switching-time data package before transfer from the program memory into the working read/write memory.

FIG. 17 shows a block diagram for an example of the test for compatibility (plausibility) of the individual data of the switching-time data package in the program memory 621, found to be complete by means of the perfection test, with the subregions for the symbol "I" 622, the days of the week "d" 623, the switching time of day in hours "h", minutes "m" and seconds "s" 624, the switch-ON-time partial data package, and correspondingly the symbol "O" 625, the days of the week "d" 626, the switching time of day 627 of the switch-OFF-time partial data package, with the entered data appertaining to the switching channel or channels "SK" 628, for possible presence of one or more inconsistencies. These include, for example, the setting switch-ON time equal to switch-OFF time with identical days of the week and the same channels. Thus, provided that $$d_I(\text{number})=d_O(\text{number}),\ SK_I=SK_O,$$

the following condition must be fulfilled:

$$T_{P/I}<T_{P/O}$$

where $T_{P/I}$ is the switch-ON time and $T_{P/O}$ is the switch-OFF time, all in the program memory 621.

Further possibilities of inconsistencies exist between the data packages in the program memory 621 and one or more switching-time data packages in the working memory (418) with the associated address counter 629, from which for compatibility testing always one entire and complete switching-time data package (630), together with at least the following half data package 631 for the same day(s) of the week and the same switching channels, is read into the buffer memory 630, 631. These switching-time data packages compulsorily have the same structure and the same composition made up of subregions as has been described in connection with the program memory.

Thus the following subregions have to be compared and related to one another (Index "I" indicates association with the switch-ON times, Index "O" with the switch-OFF times, Index P with the program memory and Index A with the working memory; "T" denotes switching time of day):

| | | Program Memory | Working Memory |
|---|---|---|---|
| Symbol | "ON" | $I_P$ | $I_A$ |
| | "OFF" | $O_P$ | $O_A$ |
| Weekdays (number) | | $d_{P/I}$ | $d_{A/I}$ |
| Switching time of day "h/m/s" six places in all, or four plus colon | | $T_{P/I}$ | $T_{A/I}$ |
| | | $T_{P/O}$ | $T_{A/O}$ |
| (AZ: address counter) | | — | $T_{A/I/AZ+1}$ |
| Channels | | $K_P$ | $K_A$ |

The following preconditions must be fulfilled in every case:

| | |
|---|---|
| $K_P = K_A$; | $I_P = I_A$; |
| $d_{P/I} = d_{A/I}$ | in both cases "number of days |
| $d_{P/O} = d_{A/O}$ | of the week" |

Then the following cases must be excluded from the transmission into the working memory of the data selected and contained in the program memory:

$$T_{P/I}>T_{A/O}\ T_{P/O}>T_{A/I/AZ+1}$$

and, independently therefrom, the data package just read out of the working memory must satisfy the condition $$T_{P/I}<T_{A/I}.$$

In examining these conditions, which have been selected as special examples but with others to be taken into account, it is necessary to distinguish among the following cases:

| | |
|---|---|
| (1) $T_{P/I} > T_{A/I}$: | the address counter is incremented by one, i.e. the next-following data package is read out with the same preconditions (above); |
| (2) $T_{P/I} = T_{A/I}$: | and one of the following conditions: |
| (a) $T_{P/I} < T_{A/I}$: | transfer or cancellation permitted |
| (b) $T_{P/O} > T_{A/O}$: | transfer into the working memory permissible if, additionally, $T_{P/I} < T_{A/I/AZ+1}$ |
| (3) $T_{P/I} < T_{A/I}$: | transfer or cancellation permitted if, additionally, $T_{P/I} > T_{A/O/AZ-1}$ |

The great majority of these conditions are reproduced in the block diagram of FIG. 17, which moreover represents as an embodiment only a selection of the possible solutions that can be realized as a logic plan in that, initially, in only two comparator stages 632, 633 the number of the days of the week as a word 634 up to three bits for the switch-ON partial data-package section $d_I$ is compared with the particular word 635 for $d_O$, on the one hand, and the highest-ranking position of the switching time of day (subsections 624, 627) as selected in any instance by the shift registers 636 and 637 and transferred for storage into the intermediate registers 638, 639, on the other hand, are compared and, consequently, an H-signal at the outputs of the NAND-elements 640, 641, i.e. an enabling signal (H) at the output of the AND-element 642, is only then transmitted to the first input of the AND-element 643. Only then are the above-described preconditions fulfilled in their first part.

In like manner the preconditions relating to the switching channels $K_P$ and $K_A$ are examined and compared by the comparator stage 644 for the number of days of the week $d_{A/I}$ or $d_{A/I/AZ+1}$ (in the intermediate memories 645 and 646) as well as the number of the week $d_{P/O}$ or $d_{A/O}$ (intermediate memories 635, 647), as well as $d_{P/I}$ or $d_{A/I}$ in the comparator stages 648, 649, the data of the symbols $O_{/P}$ and $O_{/A}$ in the subregions 625, 650, and finally the data of the symbols $I_{/P}$ and $I_A$ or $I_{/A/AZ+1}$ (the latter in the subregions 651, 652) in the comparator stages 653, 654; the signals yielded by these comparator stages must without exception be H, so that the AND-element 655 likewise delivers at its output an H signal which appears at the second input of the AND-element 643 and at the first input of the AND-element 643*a* whose output signal increments the address counter 629 by one. Thus the second part of the preconditions is satisfied.

The actual plausibility test consists of the following coupling steps: initially there appear, at the inputs of the comparator stage 656, via shift registers 636 and 657, the selected data—respectively transferred to the intermediate registers 638 and 658—of the currently highest-ranking positions of the switch-ON times of day $T_{P/I}$ of the program memory 621, or $T_{A/I}$ of the working memory 418, i.e. of the buffer memory 630, thus of the addressed switching-time data package; at the inputs of the comparator stage 659 there appear, by way of shift registers 637 and 660, the selected data—respectively transferred to the intermediate registers 639 and 661—of the currently highest-ranking positions of the switch-OFF times of day $T_{P/O}$ of the program memory 621 or $T_{A/O}$ of the buffer memory 630 of the working memory 418—with the same addressing as with the switch-ON time of day; at the inputs of the comparator stage 662, finally, there appear or together with the output signals of the intermediate registers 638 and 663—the latter by way of the shift register 644—the data of the currently highest-ranking positions of the switch-OFF times of day $T_{P/O}$ of the program memory 621 or $T_{A/I/AZ+1}$ of the next-higher address of the working memory 418 for the same days of the week and switching channels.

The outputs of the comparison stages 656, 659 and 662 are connected through the OR-element 665, the AND-element 666 and partly through the AND-element 643*a*, whose output signal increments the address counter 629 by one, and finally through the AND-element 667 in such manner that, when the conditions are fulfilled, an enabling signal appears on the output line 668 for the transfer of the complete switching-time data package in the program memory 621 into the addressed subregion between AZ and AZ+1 of the working memory 418 by way of the line 669 and the AND-elements 670, 671; the AND-element 671 furthermore becomes conductive only when the enabling signals of the perfection test lie at its inputs 672, 673 (outputs of the AND-elements 375, 376 in FIG. 11*b*). The outputs 415 to 417 and the inputs, including those for W/R and C/S switchover of the working memory 418, correspond to those of FIG. 11; an enabling signal for the cancellation of the data package or subregions thereof in the program memory of—according to the keys actuated—of the working memory is emitted by way of line 674.

Supplementations of this embodiment of the compatability test in light of the foregoing description with reference to FIG. 17 are readily possible for any person of ordinary skill in the art; the use of further tests, moreover, is merely a matter of maximum permissible cost. The latter is, as a rule, not a very serious consideration if the data correlations are carried out according to a program by means of serial processing, to which the example of parallel processing can be converted without difficulty as has already been explained in connection with the completion test.

I claim:

1. An electronic time programming apparatus comprising:

a central processor including:

at least one recording/readout working memory having addressable registers, computing means including at least one logic circuit connected to said recording/working memory for processing output signals therefrom, and at least one program memory with an associated program counter connected to said logic circuit for the generation and distribution of function signals for said central processor;

a luminous digital display connected to said central processor and divided into subregions with respective display fields for alphanumeric display;

input means including manually actuatable keys and respective switches operated by said keys and assigned to the respective display fields and arranged in groups in respective subregions, said input means being connected to said central processor;

output means connected to said central processor and having a plurality of load circuits with respective channels for the selective actuation of a respective load to be operated by said apparatus;

a common housing for said central processor, said display, said input means and said output means and having a wall provided with said display; and power means in said housing for supplying electrical power to said central processor, said input means being so connected to said central processor to define hierarchical functioning and including:

($a_1$) first function selection switch means forming part of said input means and having keys for selecting between ON and OFF of respective ones of said channels for respective ones of said load circuits of said output means and between automatic (AUT) and control (STEL) modes in which, respectively, the automatic operation of the selected channels and the setting of inputs for said channels can be effected, ($a_2$) second function selection switch means forming part of said input means and having keys for enabling said input means to key into said central processor an actual time of day (UHR) setting, a switch-ON time setting (EIN) for switching on a selected channel, a switch-OFF time setting (AUS) for switching off a respective channel, and an automatic operation setting (AUT) to enable said settings to be changed only upon both the initial operation of said first function selection means and keys for said settings of said second function selection means, and ($a_3$) further selection means including single keys each for the selection of days of the week, hour (h) and minute (m) to form the respective time settings, switch-ON and switch-OFF time input keys for registering the respective time settings and for assignment thereof to respective switching channels to input the registered time setting for the respective channels in said central processor only upon actuation of corresponding keys of said first and second function selection means and of further selection means, each of said keys of said further selection means incrementing the respective setting while it is depressed, said input means and said central processor being constructed and arranged so that signal groups for said switching ON and switching OFF times and an associated channel are transferred from intermediate memories to said central processor in totality as data packages, each data package being applicable to corresponding inputs and outputs of said program and working memories by said computer means.

2. The apparatus defined in claim 1 wherein said display subregions are provided with display elements for:

signals assigned to the respective time settings, signals assigned to the selected switching channels together with indicia representing the selected state thereof, and signals for the display of pulses representing seconds by flashing.

3. The apparatus defined in claim 1 wherein said central processor working memory has separately addressable registers assignable in groups, said program memory and said working memory being provided with a part-programming memory for a half data package with a clock time data and switch-ON and switch-OFF and channel data and spacially separated from said working memory, at least one auxiliary register forming part of said program memory and said working mem-0ory for receiving a complete data package with switch-ON and switch-OFF time data including data for days of the week and switching channels, and said memories including separately addressable further intermediate memories in said working memory for clock time data for switch-ON and switch-OFF time data for, days of the week data, for switching channel data and for actual state data of the respective channel indicating whether the same is switched on or off and means for selectively connecting said memories to each other, to said input means and to said display.

4. The apparatus defined in claim 1 wherein said program has a multiplicity of cells having outputs, said outputs of said cells of said programming memory being applied to respective inputs of a logic interconnection subassembly with respective logic circuit networks applying an output signal to the input of an AND-gate, another input of which is coupled to said programming memory, an output of said AND-gate being connected so that incomplete data as to a time setting triggers a flash command signal to each display element of an unoccupied subregion of said display associated with the respective time setting.

5. The apparatus defined in claim 4 wherein said logic circuit networks are so connected and arranged that incompatible conditions are signalled to said display flashing of signals representing incompatibly occupied memory data cells.

6. The apparatus defined in claim 3 wherein outputs of a first partial data package of said program memory and readout outputs of a second partial data package from said recording readout working memory are connected to and addressed to data packages associated with the same channel through a comparator stage in an increasing sequence from one switch-ON partial data package to the next switch-ON partial data package by means of an addressing counter incremented each time by one, means for continously incrementing the addressing counter until a third partial data package of the working memory is greater than the first partial data package of the programming memory, said comparator having an output, and means responsive to the output of said comparator for blocking transfer of data into said memory under a first set of conditions and releasing a respective complete data package from the programming memory into the working memory in a second set of conditions, the first set of conditions comprising at least one of the following:

equality of the first and fourth partial data packages of the programming memory, equality of the first and the second partial data packages of the programming memory, and equality of the fourth and third partial data packages of the programming memory and the relationship between fifth and fourth data packages of the working memory, said second set of conditions comprising a positive difference between at least one of the following:

the first switch-ON and the second switch-ON partial data packages, and the fourth switch-OFF and the third switch-OFF partial data packages.

7. The apparatus defined in claim 3, further comprising means for selectively altering the contents of a selected one of said subregions for at least one of said channels or days independently of the other subregions.

8. The apparatus defined in claim 3, further comprising means connected to said central processor for altering data of a selected one of said subregions by one value step at a time by a single actuation of one of said keys and in a direction represented by the actuation of another of said keys defining algebraic addition.

9. The apparatus defined in claim 3, further comprising means including a logic stage for canceling the effect of a previously actuated function selection key.

10. The apparatus defined in claim 3 wherein an input memory is provided for the day of the week (TAG) in the form of a shift register connected in said central processor by a logic stage capable of confirmation of multiple storage of day data.

11. The apparatus defined in claim 3 wherein said switches include channel selection switches assigned to said channels and settable independently of and outranking the function keys.

12. The apparatus defined in claim 3, further comprising a clear key forming part of said input means and connected to said central processor for canceling the electrical effect of the keys actuated in an immediately preceding step and for the erasure of a corresponding section of said display.

13. The apparatus defined in claim 3 wherein said function selection keys are provided in circuit with a shift register device for switching them over from the control circuit of a respective function selection to another in the sequence UHR-EIN-AUS-AS 1 . . . -AUT-UHR by successive actuation of at least one of said keys.

14. The apparatus defined in claim 3, further comprising means forming part of said central processor and including a timing circuit for resetting the function selection keys after the lapse of a presettable time interval if none of the function setting keys is actuated within this interval.

15. The apparatus defined in claim 3 wherein said keys and switches are provided on a panel of said housing in a matrix consisting of groups spaced to reflect their functions.

16. The apparatus defined in claim 3 wherein each function selection key is connected to an AND gate and a flip-flop and provided with a clock pulse source so that each time a function key is actuated the flip-flops of all other such keys are reset.

17. The apparatus defined in claim 3 wherein said central processor includes an electric clock having an output signal connected via a respective command gate to each input of a plurality of said logic circuit together with output signals of intermediate memories representing data sections of actual time of day, switch-ON and switch-OFF times, week days and switching channels, the other inputs of each of said and gates being controlled by an output signal of a flip-flop connected to a switch associated with the AUT key.

18. The apparatus defined in claim 3 wherein bistable switches are provided for each of said keys for locking the state thereof in one of two operating conditions.

19. The apparatus defined in claim 3 in which a two-position switch having a set position (STEL) and an automatic position (AUT) is provided in a control circuit of each of the function selection keys with the exception of the AUT key for blocking the input of the respective function selection key upon activation of said AUT key.

20. The apparatus defined in claim 3 wherein said input means includes a clear key (CLE) having a signal circuit including an OR gate having an output applied to a resetting input of respective monoflops in signal circuits of respective setting keys of said input means and a $\overline{Q}$ output signal of a time delay controlled monostable flop member is connected in respective resetting circuits of flip-flops of signal circuits of the respective function key, an input of said flop member being commanded by an OR gate which is input controlled by $\overline{Q}$ output signals of said flipflops.

21. The apparatus defined in claim 1 wherein said central processor includes a microprocessor formed with said logic circuit and at least part of said memories.

22. The apparatus defined in claim 21 wherein said display has liquid crystal display elements and is formed in a compact semiconductor unit technologically integrated with said microprocessor.

23. The apparatus defined in claim 22 wherein said semiconductor unit is mounted on a circuitboard held in said housing between an upper casing and a lower casing part, said upper casing part having a window through which said display fields can be viewed, said keys being provided adjacent said window on said upper casing part, said casing parts having matched wall edges and being provided with means for securing them together to form said housing.

24. The apparatus defined in claim 23 wherein said circuitboard is reinforced by further circuitboards positioned at right angles to the first mentioned circuitboard.

25. The apparatus defined in claim 23 wherein said lower casing part has grooves at two opposite side walls for holding it to said upper casing part.

26. The apparatus defined in claim 1 wherein said keys are formed with fingers composed of an elastomeric electrical conductive material, each finger having a neck of rectangular cross section, said keys being guided through a respective rectangular perforation in said wall of said housing and cooperating with conducting tracks within said housing.

27. The apparatus defined in claim 1 wherein said keys are provided in operating and setting fields adjusting said display fields, said display fields and said operating and setting fields having adjacent sides of approximately equal length such that both form an elongated rectangul on said wall with a side ratio of two to one.

* * * * *